US011713926B2

(12) United States Patent
Komiya et al.

(10) Patent No.: US 11,713,926 B2
(45) Date of Patent: Aug. 1, 2023

(54) HEAT EXCHANGER AND REFRIGERATION CYCLE APPARATUS

(71) Applicants: Mitsubishi Electric Corporation, Tokyo (JP); The University of Tokyo, Tokyo (JP)

(72) Inventors: Yuta Komiya, Tokyo (JP); Shinya Higashiiue, Tokyo (JP); Tsuyoshi Maeda, Tokyo (JP); Ryota Akaiwa, Tokyo (JP); Shigeyoshi Matsui, Tokyo (JP); Akira Ishibashi, Tokyo (JP); Eiji Hihara, Tokyo (JP); Chaobin Dang, Tokyo (JP); Jiyang Li, Tokyo (JP)

(73) Assignees: Mitsubishi Electric Corporation, Tokyo (JP); The University of Tokyo, Tokyo (JP)

( * ) Notice: Subject to any disclaimer, the term of this patent is extended or adjusted under 35 U.S.C. 154(b) by 0 days.

(21) Appl. No.: 17/699,852

(22) Filed: Mar. 21, 2022

(65) Prior Publication Data

US 2022/0236012 A1 Jul. 28, 2022

Related U.S. Application Data

(62) Division of application No. 16/627,550, filed as application No. PCT/JP2017/028257 on Aug. 3, 2017.

(51) Int. Cl.
*F28F 1/20* (2006.01)
*F28D 1/053* (2006.01)
(Continued)

(52) U.S. Cl.
CPC ..... *F28D 1/024* (2013.01); *F25B 39/00* (2013.01); *F28D 1/03* (2013.01); *F28D 1/05383* (2013.01); *F28F 1/20* (2013.01); *F28F 13/12* (2013.01)

(58) Field of Classification Search
CPC ..... F28F 1/20; F28F 13/12; F28D 1/05383
See application file for complete search history.

(56) References Cited

U.S. PATENT DOCUMENTS 1,125,113 A * 1/1915 Junkers ..... F28F 1/22 165/171
2,281,299 A 4/1942 Steenstrup
(Continued)

FOREIGN PATENT DOCUMENTS

FR 2 192 282 A1 2/1974
JP S52-96445 U 7/1977
(Continued)

OTHER PUBLICATIONS

International Search Report of the International Searching Authority dated Nov. 7, 2017 for the corresponding International application No. PCT/JP2017/028257 (and English translation).
(Continued)

*Primary Examiner* — Leonard R Leo
(74) *Attorney, Agent, or Firm* — Posz Law Group, PLC

(57) ABSTRACT

Provided is a heat exchanger, including a plurality of heat exchange members arranged in a first direction so as to be spaced apart from each other. Each of the plurality of heat exchange members includes: a heat transfer pipe extending in a second direction intersecting with the first direction; and a heat transfer plate provided to the heat transfer pipe along the second direction. The heat transfer plate includes extending portions extending away from the heat transfer pipe in a third direction intersecting with each of the first direction and the second direction. The heat transfer plate is formed separately from the heat transfer pipe.

12 Claims, 23 Drawing Sheets

(51) Int. Cl.

| | |
|---|---|
| ***F28D 1/02*** | (2006.01) |
| ***F25B 39/00*** | (2006.01) |
| ***F28D 1/03*** | (2006.01) |
| *F28F 13/12* | (2006.01) |

(56) References Cited

U.S. PATENT DOCUMENTS

| | | | | | |
|---|---|---|---|---|---|
| 2,294,030 | A | | 8/1942 | Higham et al. | |
| 2,650,802 | A | * | 9/1953 | Huet | F28F 1/14 165/183 |
| 2,795,402 | A | * | 6/1957 | Modine | F28F 19/06 165/170 |
| 3,039,453 | A | * | 6/1962 | Andrassy | F24S 10/755 165/171 |
| 3,111,168 | A | * | 11/1963 | Huet | F28F 1/14 165/183 |
| 3,190,352 | A | * | 6/1965 | Simpelaar | F28F 1/14 165/183 |
| 3,379,241 | A | * | 4/1968 | Gau | F25B 39/04 165/171 |
| 4,079,781 | A | * | 3/1978 | Wesseltoft | F24D 3/148 165/171 |
| 4,135,575 | A | | 1/1979 | Gersch | |
| 4,351,321 | A | * | 9/1982 | Johnson | F24S 10/755 126/659 |
| 5,094,292 | A | * | 3/1992 | Buckshaw | F22B 37/107 165/110 |
| 5,236,045 | A | * | 8/1993 | Janezich | F28F 1/02 165/183 |
| 5,469,915 | A | | 11/1995 | Cesaroni | |
| 5,782,291 | A | * | 7/1998 | Morita | F28D 1/05391 165/183 |
| 5,829,516 | A | * | 11/1998 | Lavochkin | H01L 25/117 29/890.038 |
| 5,930,962 | A | * | 8/1999 | Sokolean | E04C 2/525 165/171 |
| 6,910,526 | B1 | * | 6/2005 | Sokolean | F28F 1/22 165/171 |
| 6,918,435 | B2 | * | 7/2005 | Dwyer | F28D 1/05333 29/890.047 |
| 2003/0150226 | A1 | | 8/2003 | Jensen | |
| 2013/0206376 | A1 | | 8/2013 | Shikazono et al. | |
| 2014/0231056 | A1 | | 8/2014 | Covington et al. | |

FOREIGN PATENT DOCUMENTS

| | | | | | |
|---|---|---|---|---|---|
| JP | S53-78948 | A | | 7/1978 | |
| JP | S53-134244 | A | | 11/1978 | |
| JP | S56-112485 | U | | 8/1981 | |
| JP | S57-134698 | A | | 8/1982 | |
| JP | 04020792 | A | * | 1/1992 | F28F 1/32 |
| JP | 2005-140352 | A | | 6/2005 | |
| JP | 2006-112731 | A | | 4/2006 | |
| JP | 2008-202896 | A | | 9/2008 | |
| JP | 2012-251719 | A | | 12/2012 | |
| JP | 2013-024468 | A | | 2/2013 | |
| JP | 2014-081113 | A | | 5/2014 | |

OTHER PUBLICATIONS

Office Action dated May 19, 2020 issued in corresponding JP patent application No. 2019-533829 (and English translation).
Extended European Search Report dated Jun. 18, 2020 issued in corresponding EP patent application No. 17920531.5.
Office Action dated Jan. 4, 2022 issued in corresponding JP patent application No. 2021-033995 (and English machine translation).

* cited by examiner

HEAT EXCHANGER AND REFRIGERATION CYCLE APPARATUS

CROSS REFERENCE TO RELATED APPLICATIONS

The present application is a divisional application of U.S. utility application Ser. No. 16/627,550 filed on Dec. 30, 2019, which is a U.S. national stage application of PCT/JP2017/028257 filed on Aug. 3, 2017, the contents of which are incorporated herein by reference.

TECHNICAL FIELD

The present invention relates to a heat exchanger including a plurality of heat transfer pipes, and a refrigeration cycle apparatus including the heat exchanger.

BACKGROUND

There has hitherto been known a heat exchanger having the following configuration for improving heat exchange efficiency between refrigerant flowing through heat transfer pipes and an outside air. Specifically, a plurality of heat transfer pipes each having a flat shape are arranged so that a width direction thereof extends along a direction of an air stream, and projecting portions project along the direction of the air stream from both ends of each of the heat transfer pipes in the width direction (see, for example, Patent Literature 1).

PATENT LITERATURE

[PTL 1] JP 2008-202896 A

In the related-art heat exchanger disclosed in Patent Literature 1, however, the heat transfer pipe and the projecting portion are formed of an integrated single member. Thus, an integrated shape of the heat transfer pipe and the projecting portion is complicated, with the result that time and effort are required for manufacturing work for the heat transfer pipes and the projecting portions.

SUMMARY

The present invention has been made to solve the problem described above, and has an object to provide a heat exchanger, which can be improved in heat exchange performance and can easily be manufactured.

According to one embodiment of the present invention, there is provided a heat exchanger, including a plurality of heat exchange members arranged in a first direction so as to be spaced apart from each other, wherein each of the plurality of heat exchange members includes: a heat transfer pipe extending in a second direction intersecting with the first direction; and a heat transfer plate provided to the heat transfer pipe along the second direction, wherein the heat transfer plate includes extending portions extending away from the heat transfer pipe in a third direction intersecting with each of the first direction and the second direction, and wherein the heat transfer plate is a member formed separately from the heat transfer pipe.

With the heat exchanger and the refrigeration cycle apparatus according to one embodiment of the present invention, a heat transfer area of each of the heat exchange members to be brought into contact with an air stream can be increased with the presence of the extending portion to thereby improve heat exchange performance of the heat exchanger.

Further, the heat transfer pipe and the heat transfer plate can be manufactured separately, and hence a shape of the heat transfer pipe and a shape of the heat transfer plate can be simplified. As a result, the heat exchanger can easily be manufactured.

DETAILED DESCRIPTION

Now, preferred embodiments of the present invention are described with reference to the accompanying drawings.

First Embodiment

Figure 1:
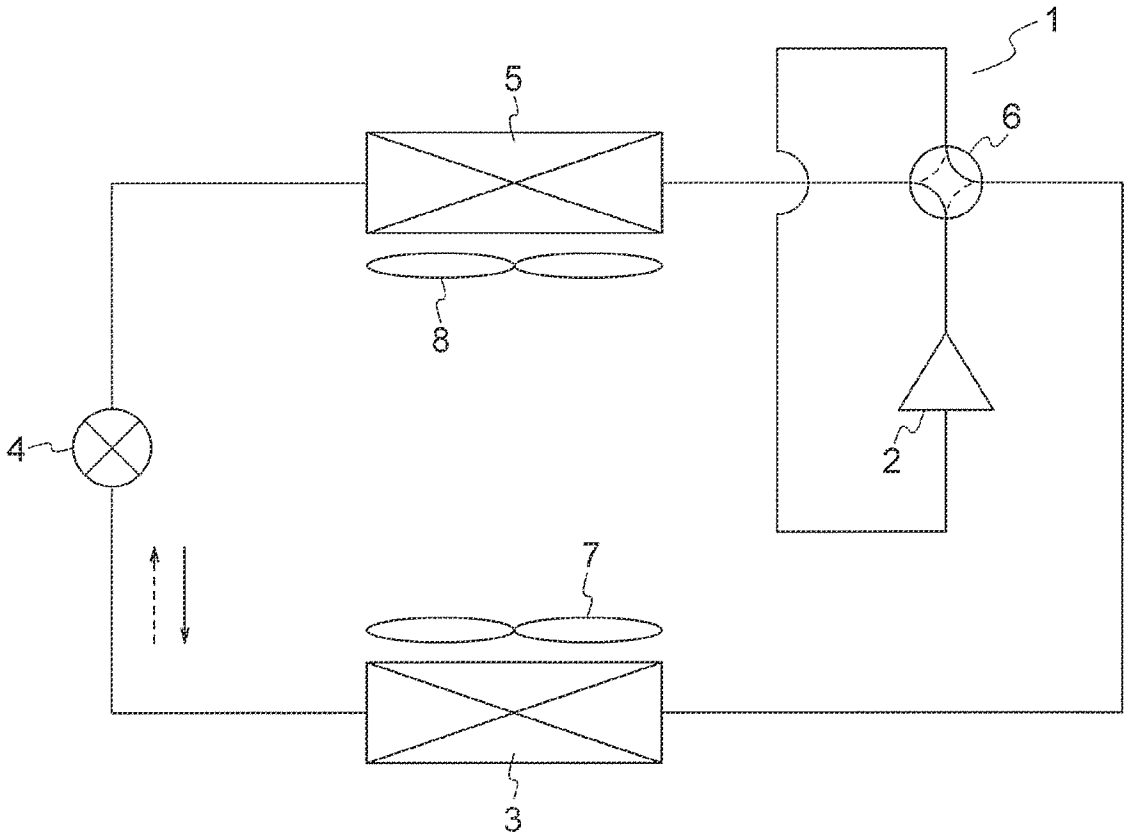
FIG. 1 is a schematic configuration diagram for illustrating an air conditioning apparatus according to a first embodiment of the present invention.

FIG. 1 is a schematic configuration diagram for illustrating a refrigeration cycle apparatus according to a first embodiment of the present invention. In this embodiment, the refrigeration cycle apparatus is used as an air conditioning apparatus 1. The air conditioning apparatus 1 includes a compressor 2, an outdoor heat exchanger 3, an expansion valve 4, an indoor heat exchanger 5, and a four-way valve 6. In this example, the compressor 2, the outdoor heat exchanger 3, the expansion valve 4, and the four-way valve 6 are provided to an outdoor unit. The indoor heat exchanger 5 is provided to an indoor unit.

The compressor 2, the outdoor heat exchanger 3, the expansion valve 4, the indoor heat exchanger 5, and the four-way valve 6 are connected to each other through refrigerant pipes to form a refrigerant circuit through which the refrigerant can circulate. In the air conditioning apparatus 1, a refrigeration cycle in which the refrigerant circulates through the compressor 2, the outdoor heat exchanger 3, the expansion valve 4, and the indoor heat exchanger 5 while being changed in phase is performed by drive of the compressor 2.

An outdoor fan 7 configured to force an outdoor air to pass through the outdoor heat exchanger 3 is provided to the outdoor unit. The outdoor heat exchanger 3 exchanges heat between an air stream of the outdoor air, which is generated by an operation of the outdoor fan 7, and the refrigerant. An indoor fan 8 configured to force an indoor air to pass through the indoor heat exchanger 5 is provided to the indoor unit. The indoor heat exchanger 5 exchanges heat between an air stream of the indoor air, which is generated by an operation of the indoor fan 8, and the refrigerant.

An operation of the air conditioning apparatus 1 can be switched between a cooling operation and a heating operation. The four-way valve 6 is an electromagnetic valve configured to switch a refrigerant flow passage in accordance with the switching between the cooling operation and the heating operation of the air conditioning apparatus 1. The four-way valve 6 guides the refrigerant from the compressor 2 to the outdoor heat exchanger 3 and the refrigerant from the indoor heat exchanger 5 to the compressor 2 during the cooling operation, and guides the refrigerant from the compressor 2 to the indoor heat exchanger 5 and the refrigerant from the outdoor heat exchanger 3 to the compressor 2 during the heating operation. In FIG. 1, a direction of a flow of the refrigerant during the cooling operation is indicated by the broken-line arrow, and a direction of a flow of the refrigerant during the heating operation is indicated by the solid-line arrow.

During the cooling operation of the air conditioning apparatus 1, the refrigerant compressed by the compressor 2 is sent to the outdoor heat exchanger 3. In the outdoor heat exchanger 3, the refrigerant rejects heat to the outdoor air and is condensed. After that, the refrigerant is sent to the expansion valve 4. After being decompressed by the expansion valve 4, the refrigerant is sent to the indoor heat exchanger 5. Then, after the refrigerant takes heat from the indoor air and evaporates in the indoor heat exchanger 5, the refrigerant returns to the compressor 2. Thus, during the cooling operation of the air conditioning apparatus 1, the outdoor heat exchanger 3 functions as a condenser, and the indoor heat exchanger 5 functions as an evaporator.

During the heating operation of the air conditioning apparatus 1, the refrigerant compressed by the compressor 2 is sent to the indoor heat exchanger 5. In the indoor heat exchanger 5, the refrigerant rejects heat to the indoor air and is condensed. After that, the refrigerant is sent to the expansion valve 4. After being decompressed by the expansion valve 4, the refrigerant is sent to the outdoor heat exchanger 3. Then, after the refrigerant takes heat from the outdoor air and evaporates in the outdoor heat exchanger 3, the refrigerant returns to the compressor 2. Thus, during the heating operation of the air conditioning apparatus 1, the outdoor heat exchanger 3 functions as an evaporator, and the indoor heat exchanger 5 functions as a condenser.

Figure 2:
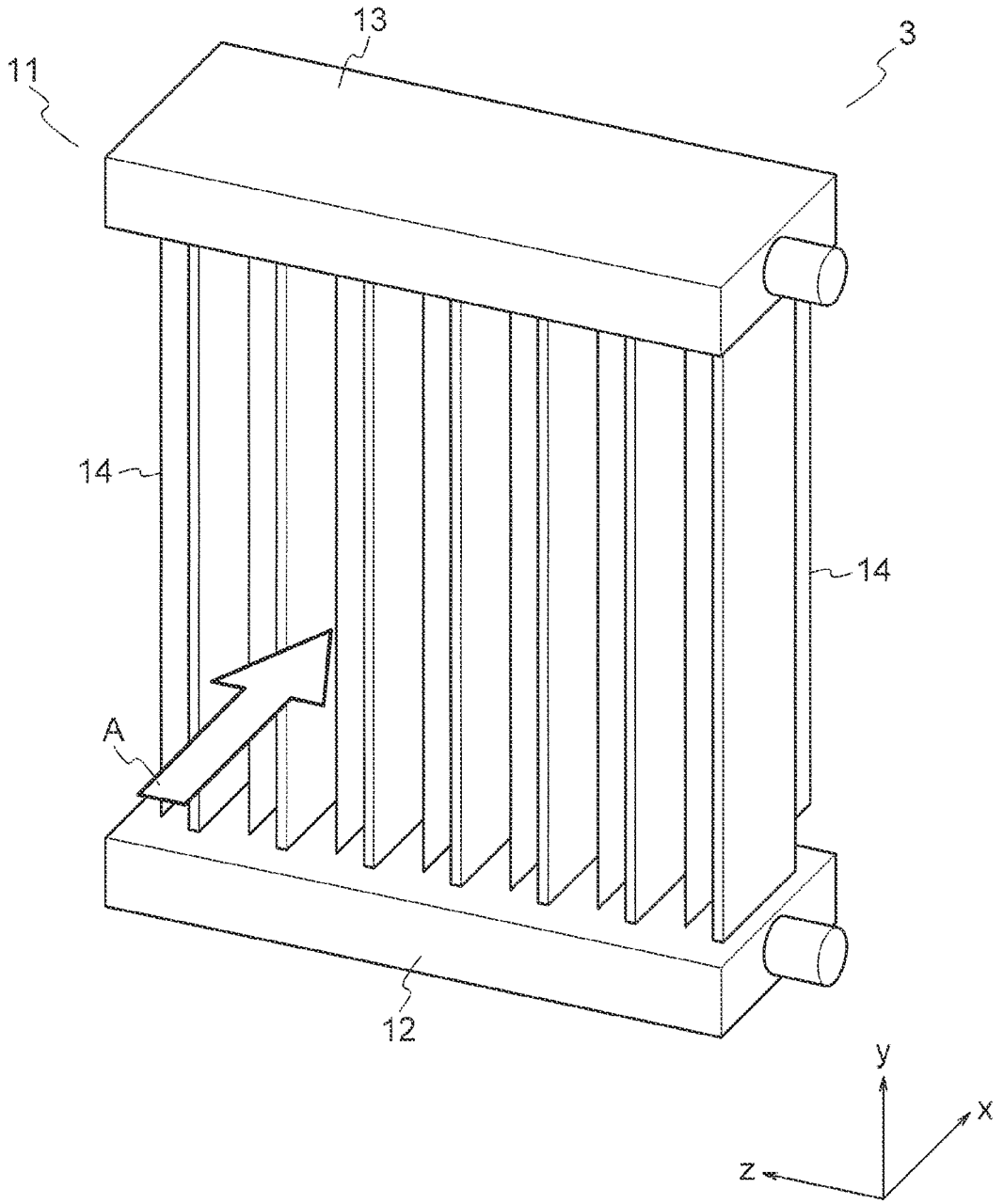
FIG. 2 is a perspective view for illustrating an outdoor heat exchanger of FIG. 1.

FIG. 2 is a perspective view for illustrating the outdoor heat exchanger 3 of FIG. 1. The outdoor heat exchanger 3 includes a heat exchanger main body 11 through which an air stream A generated by the operation of the outdoor fan 7 passes. The heat exchanger main body 11 includes a first header tank 12, a second header tank 13, and a plurality of heat exchange members 14, which connect the first header tank 12 and the second header tank 13 to each other. In the heat exchanger main body 11, one of a refrigerant pipe from the expansion valve 4 and a refrigerant pipe from the four-way valve 6 is connected to the first header tank 12, and another one is connected to the second header tank 13.

Each of the first header tank 12 and the second header tank 13 is horizontally arranged. Further, the second header tank 13 is arranged above the first header tank 12. The first header tank 12 and the second header tank 13 are arranged so as to be parallel to each other along a z direction of FIG. 2, which is a first direction.

The plurality of heat exchange members 14 are arranged so as to be spaced apart from each other in a longitudinal direction of each of the first header tank 12 and the second header tank 13, specifically, in the z direction of FIG. 2. Further, the plurality of heat exchange members 14 are arranged in parallel to each other. A longitudinal direction of the plurality of heat exchange members 14 matches with a second direction intersecting with the z direction of FIG. 2, which is the first direction. In this example, the second direction is a y direction of FIG. 2, which is orthogonal to the z direction of FIG. 2. The longitudinal direction of each of the heat exchange members 14 is orthogonal to the longitudinal direction of each of the first header tank 12 and the second header tank 13. In this example, arrangement of a member in a space between the plurality of heat exchange members 14 is prohibited. With the arrangement described above, in this example, connection of a member to surfaces of adjacent ones of the heat exchange members 14, which are opposed to each other, is avoided.

The air stream A generated by the operation of the outdoor fan 7 passes between the plurality of heat exchange members 14. In this example, the air stream A passes between the plurality of heat exchange members 14 along a direction orthogonal to the longitudinal direction of the first header tank 12 and the second header tank 13 and the longitudinal direction of each of the heat exchange members 14, specifically, along an x direction of FIG. 2.

Figure 3:
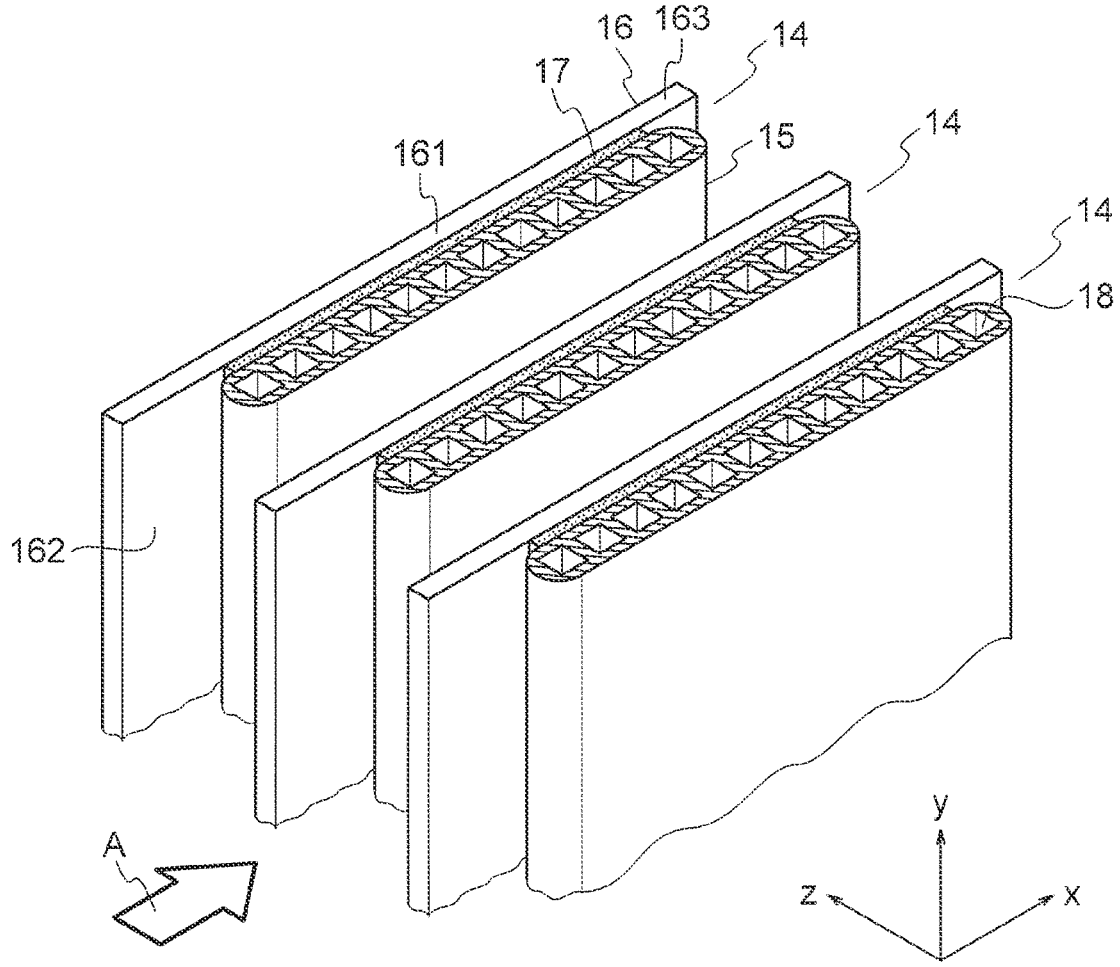
FIG. 3 is a perspective view for illustrating a state in which heat exchange members of FIG. 2 are cut.
Figure 4:
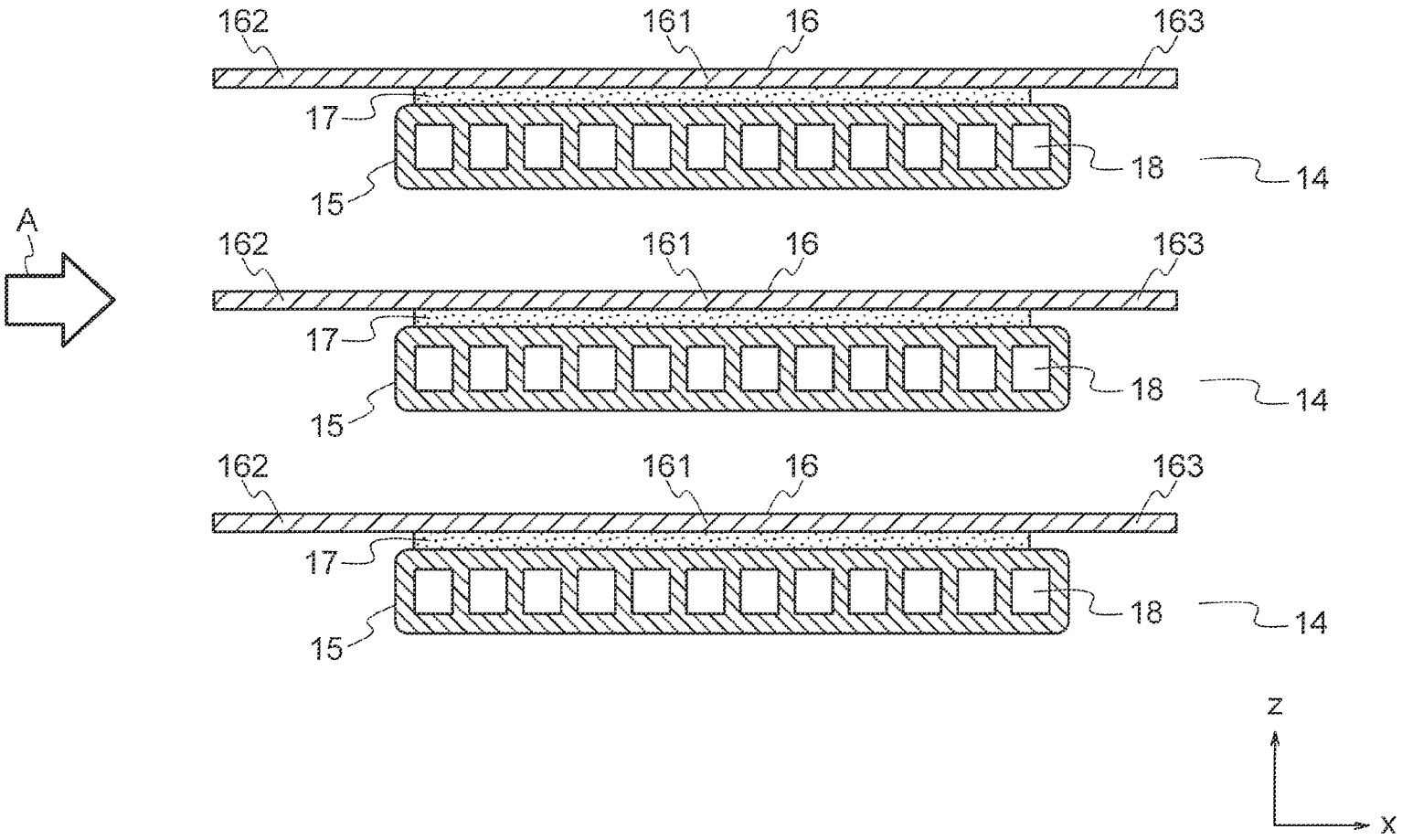
FIG. 4 is a sectional view for illustrating the heat exchange members of FIG. 3.

FIG. 3 is a perspective view for illustrating a state in which the heat exchange members 14 of FIG. 2 are cut. FIG. 4 is a sectional view for illustrating the heat exchange members 14 of FIG. 3. Each of the plurality of heat exchange members 14 includes a heat transfer pipe 15, a heat transfer plate 16, and a joining member 17. The heat transfer pipe 15 extends in the y direction being the second direction. The heat transfer plate 16 is provided to the heat transfer pipe 15 along a longitudinal direction of the heat transfer pipe 15, specifically, the second direction. The joining member 17 is provided between the heat transfer pipe 15 and the heat transfer plate 16, and is configured to join the heat transfer plate 16 to the heat transfer pipe 15.

A sectional shape of the heat transfer pipe 15 cut along a plane orthogonal to the longitudinal direction of the heat transfer pipe 15 is a flat shape having a long axis and a short axis. Thus, when a long axis direction of a cross section of the heat transfer pipe 15 is set as a width direction of the heat transfer pipe 15, and a short axis direction of the cross section of the heat transfer pipe 15 is set as a thickness direction of the heat transfer pipe 15, a dimension of the heat transfer pipe 15 in the width direction is larger than a dimension of the heat transfer pipe 15 in the thickness direction. Each of the heat transfer pipes 15 is arranged in a state in which the thickness direction of the heat transfer pipe 15 matches with a direction in which the plurality of heat transfer pipes 15 are arranged, specifically, the z direction, and the width direction of the heat transfer pipe 15 matches with a direction of the air stream A, specifically, the x direction.

A plurality of refrigerant flow passages 18 through which the refrigerant flows are arranged inside the heat transfer pipe 15 along the longitudinal direction of the heat transfer pipe 15. The plurality of refrigerant flow passages 18 are arranged side by side in the width direction of the heat transfer pipe 15. In the heat exchange member 14, heat is exchanged between the air stream A passing between the plurality of heat exchange members 14 and the refrigerant flowing through the refrigerant flow passages 18.

The heat transfer pipe 15 is made of a metal material having heat conductivity. As the material for forming the heat transfer pipe 15, for example, aluminum, an aluminum alloy, copper, or a copper alloy is used. The heat transfer pipe 15 is manufactured by extrusion for extruding a heated material through a hole of a die to form the cross section of the heat transfer pipe 15. The heat transfer pipe 15 may be manufactured by drawing for drawing a material through a hole of a die to form the cross section of the heat transfer pipe 15.

The heat transfer plate 16 is a member formed separately from the heat transfer pipe 15. Further, the heat transfer plate 16 is arranged along a third direction, which intersects with the z direction being the first direction and the y direction being the second direction. In this example, the third direction is the x direction orthogonal to each of the z direction and the y direction. The heat transfer plate 16 is a flat plate arranged along the x direction. The heat exchanger main body 11 is arranged so that the direction of the air stream A matches with the x direction. A dimension of the heat transfer plate 16 in the thickness direction is smaller than a dimension of the heat transfer pipe 15 in the thickness direction. The heat transfer plate 16 is made of a metal material having heat conductivity. As the material for forming the heat transfer plate 16, for example, aluminum, an aluminum alloy, copper, or a copper alloy is used.

The heat transfer plate 16 includes one extending portion 162, another extending portion 163, and a heat transfer plate main body portion 161. The one extending portion 162 and the another extending portion 163 extend away from the heat transfer pipe 15 on both sides of the heat transfer pipe 15 in the x direction being the third direction. The heat transfer plate main body portion 161 is continuous with the one extending portion 162 and the another extending portion 163. The heat transfer plate main body portion 161 overlaps an outer peripheral surface of the heat transfer pipe 15. The one extending portion 162 extends from the heat transfer plate main body portion 161 toward an upstream side of the air stream A with respect to the heat transfer pipe 15. The another extending portion 163 extends from the heat transfer plate main body portion 161 toward a downstream side of the air stream A with respect to the heat transfer pipe 15. In this example, a dimension of the extending portion 162 on the upstream side is larger than a dimension of the extending portion 163 on the downstream side in the x direction.

The heat transfer plate main body portion 161 overlaps a portion of the outer peripheral surface of the heat transfer pipe 15, which extends along the width direction of the heat transfer pipe 15, through the joining member 17 therebetween. The extending portion 162 on the upstream side and the extending portion 163 on the downstream side are present outside a region of the heat transfer pipe 15 in the width direction of the heat transfer pipe 15 when viewed along the thickness direction of the heat transfer pipe 15, specifically, the z direction.

The joining member 17 is made of a metal material having heat conductivity. As the material for forming the joining member 17, for example, aluminum, an aluminum alloy, copper, or a copper alloy is used. In this example, a brazing filler metal is used for the joining member 17. A melting point of the material for forming the joining member 17 is set lower than a melting point of the material for forming the heat transfer pipe 15 and a melting point of the material for forming the heat transfer plate 16.

Figure 5:
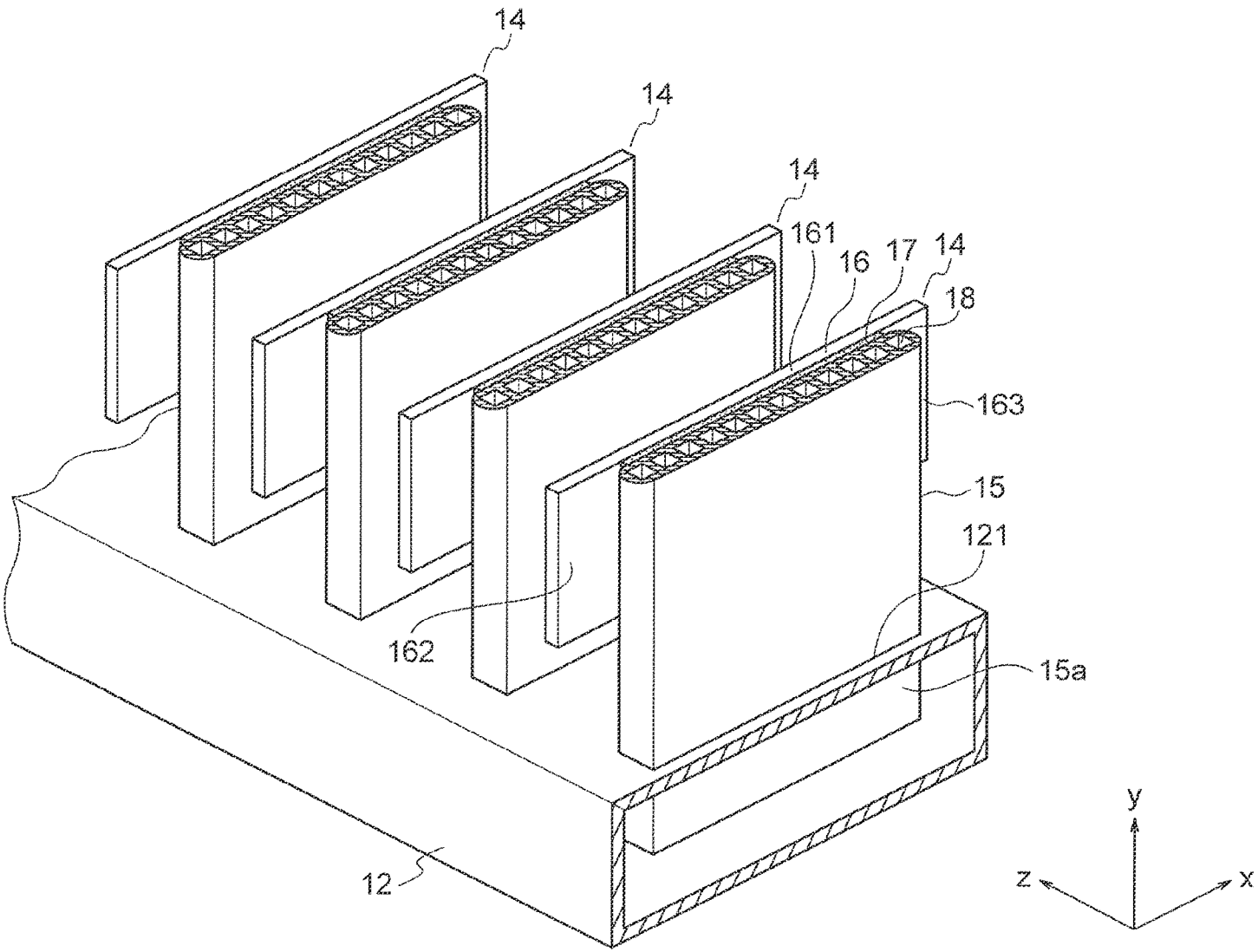
FIG. 5 is a perspective view for illustrating a lower part of a heat exchanger main body of FIG. 1.
Figure 6:
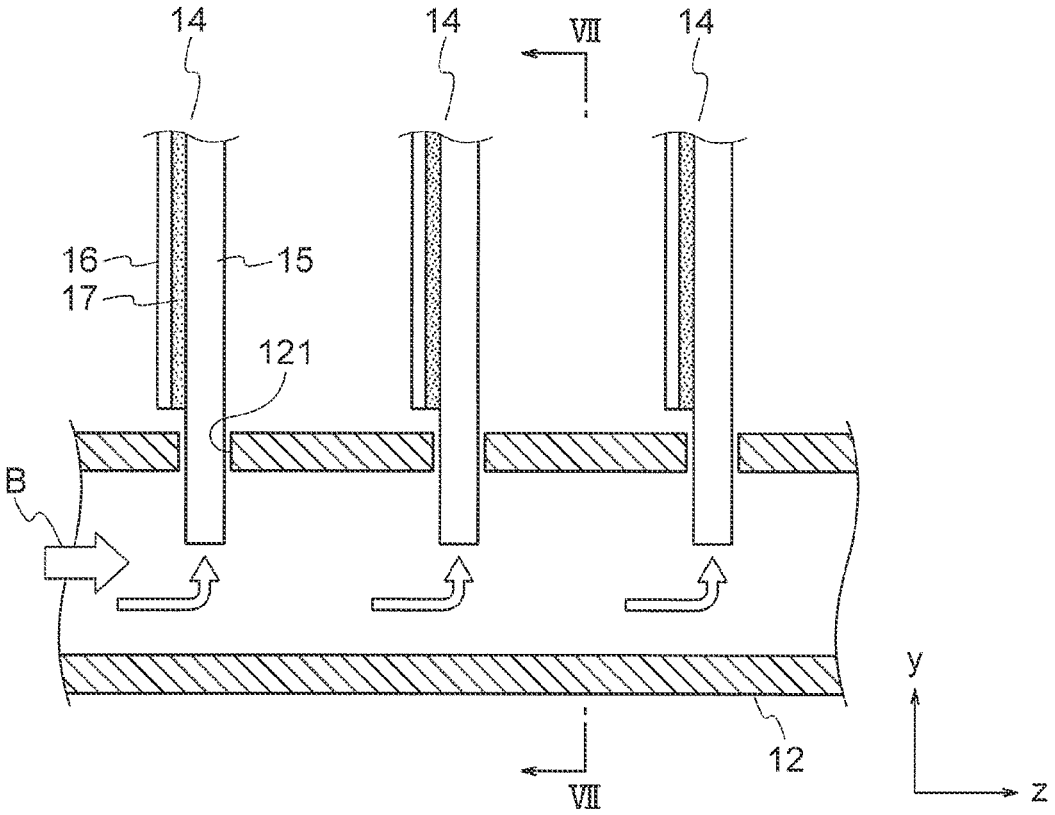
FIG. 6 is a longitudinal sectional view for illustrating the lower part of the heat exchanger main body of FIG. 5.
Figure 7:
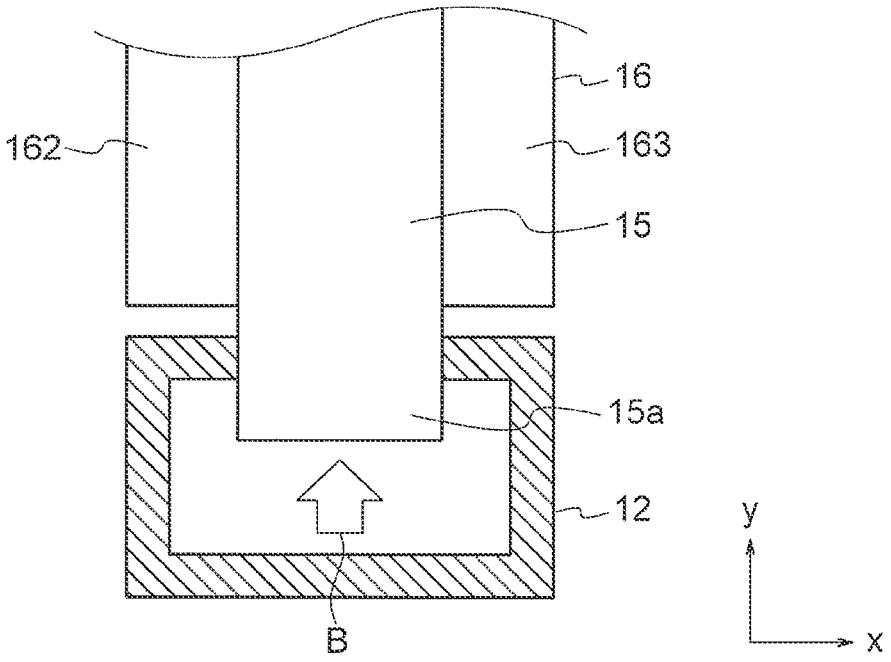
FIG. 7 is a sectional view taken along the line VII-VII of FIG. 6.

FIG. 5 is a perspective view for illustrating a lower part of the heat exchanger main body 11 of FIG. 1. FIG. 6 is a longitudinal sectional view for illustrating the lower part of the heat exchanger main body 11 of FIG. 5. FIG. 7 is a sectional view taken along the line VII-VII of FIG. 6. The first header tank 12 has a plurality of insertion holes 121 passing through an upper wall portion of the first header tank 12. The second header tank 13 has a plurality of insertion holes (not shown) passing through a lower wall portion of the second header tank 13. The plurality of insertion holes 121 formed in the first header tank 12 and the second header tank 13 are formed so as to be matched with positions of the plurality of heat exchange members 14.

In each of the heat exchange members 14, both end portions 15*a* of the heat transfer pipe 15 in the longitudinal direction project from the heat transfer plate 16. One end portion 15*a* of the heat transfer pipe 15 in the longitudinal direction is inserted into a space inside the first header tank 12 in a state of being inserted through the insertion hole 121 of the first header tank 12, and another end portion 15*a* of the heat transfer pipe 15 in the longitudinal direction is inserted into a space inside the second header tank 13 in a state of being inserted through the insertion hole of the second header tank 13. Specifically, only the one end portion 15*a* of the heat transfer pipe 15 of the heat exchange member 14 in the longitudinal direction is inserted into the space inside the first header tank 12, and only the another end portion 15*a* of the heat transfer pipe 15 of the heat exchange member 14 in the longitudinal direction is inserted into the space inside the second header tank 13. In this manner, the space inside the first header tank 12 and the space inside the second header tank 13, and the refrigerant flow passages 18 of the heat transfer pipes 15 are brought into communication with each other. Each of the heat transfer pipes 15 is connected to the first header tank 12 and the second header tank 13 by, for example, brazing or welding. A refrigerant B flows through the first header tank 12, the refrigerant flow passages 18, and the second header tank 13 in the started order or through the second header tank 13, the refrigerant flow passages 18, and the first header tank 12 in the started order in accordance with the cooling operation and the heating operation.

In the heat exchanger main body 11, heat is exchanged between the air stream A generated by the operation of the outdoor fan 7 and the refrigerant B flowing through the refrigerant flow passages 18 of the heat transfer pipes 15. Thus, heat exchange performance of the heat exchanger main body 11 is improved as an area of each of the heat exchange members 14, with which the air stream A comes into contact, increases.

When the outdoor heat exchanger 3 functions as a condenser, the refrigerant B having a temperature higher than a temperature of the air stream A flows through the refrigerant flow passages 18. Thus, when the outdoor heat exchanger 3 functions as a condenser, heat is rejected from the refrigerant B to the air stream A.

When the outdoor heat exchanger 3 functions as an evaporator, the refrigerant B having a temperature lower than a temperature of the air stream A flows through the refrigerant flow passages 18. Thus, when the outdoor heat exchanger 3 functions as an evaporator, heat is taken from the air stream A into the refrigerant B. On this occasion, dew condensation water is sometimes generated on a surface of the heat exchange member 14.

Figure 8:
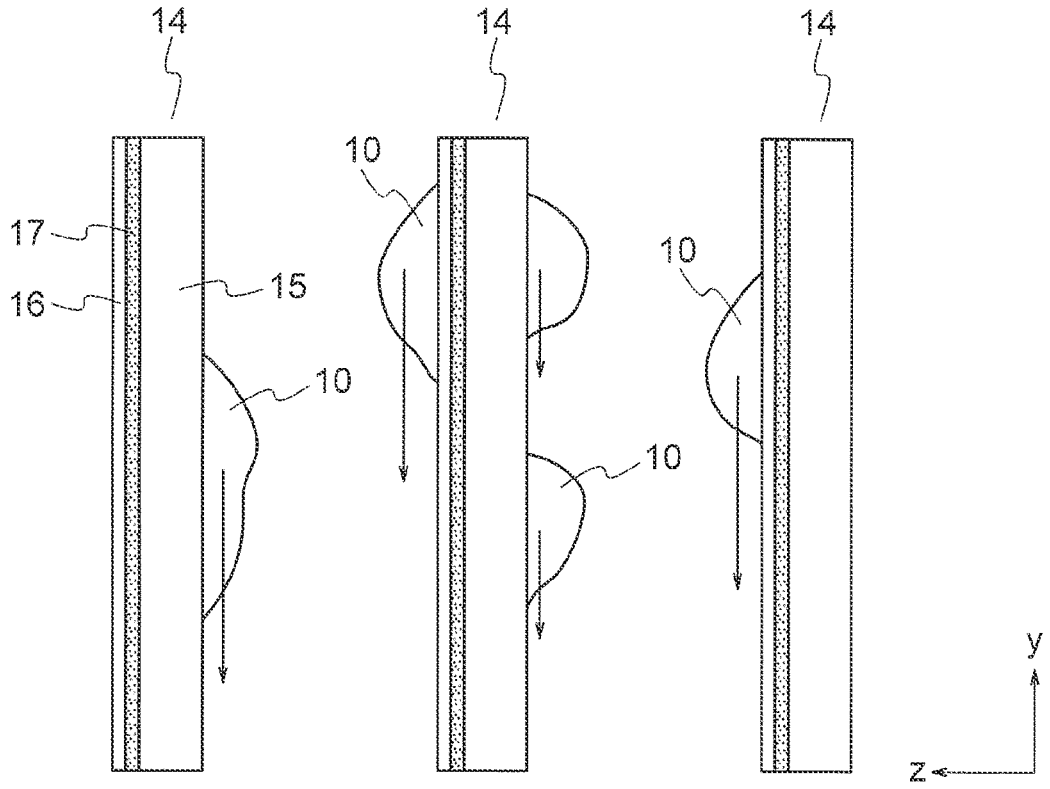
FIG. 8 is a front view for illustrating a state in which dew condensation water adheres to the heat exchange members of FIG. 3.

FIG. 8 is a front view for illustrating a state in which dew condensation water adheres to the heat exchange members 14 of FIG. 3. Dew condensation water 10 adhering to the surface of each of the heat exchange members 14 moves downward by its own weight along the surface of each of the heat exchange members 14. On this occasion, no member is connected to the surface of each of the heat exchange members 14, and hence the downward movement of the dew condensation water 10 is not inhibited by a member. As a result, the dew condensation water 10 is easily discharged downward.

The heat exchanger main body 11 is manufactured by heating an assembled body including the heat transfer pipes 15, the heat transfer plates 16, the first header tank 12, and the second header tank 13 in a furnace. A brazing filler metal is applied in advance to the surface of each of the heat transfer pipes 15 and the surface of each of the heat transfer plates 16. The heat transfer pipes 15, the heat transfer plates 16, the first header tank 12, and the second header tank 13 are fixed to each other with the brazing filler metal molten by heating in the furnace. The brazing filler metal is provided as the joining member 17 between each pair of the heat transfer pipe 15 and the heat transfer plate 16.

In the outdoor heat exchanger 3 described above, each of the heat transfer plates 16 includes the extending portions 162 and 163, which extend away from the heat transfer pipe 15 in the x direction being the third direction. Thus, a heat transfer area of each of the heat exchange members 14, which is brought into contact with the air stream A, can be increased with the presence of the extending portions 162 and 163. Thus, the heat exchange performance of the outdoor heat exchanger 3 can be improved. Further, the heat transfer plate 16 is a member formed separately from the heat transfer pipe 15. Thus, the heat transfer pipe 15 and the heat transfer plate 16 can be manufactured separately from each other. Thus, a shape of the heat transfer pipe 15 and a shape of the heat transfer plate 16 can be simplified. In this manner, each of the heat transfer pipe 15 and the heat transfer plate 16 can easily be manufactured. Thus, the outdoor heat exchanger 3 can easily be manufactured.

The end portions 15*a* of the heat transfer pipe 15 in the longitudinal direction project from the heat transfer plate 16. Further, the end portions 15*a* of the heat transfer pipe 15 in the longitudinal direction are inserted into the space inside the first header tank 12 and the space inside the second header tank 13, respectively. Accordingly, a shape of each of the insertion holes 121 through which the heat exchange members 14 are inserted can be formed so as to be matched with a shape of the outer peripheral surface of each of the heat transfer pipes 15. As a result, complication of the shape of each of the insertion holes 121 can be prevented. In this manner, connection work for the heat exchange members 14 to the first header tank 12 and the second header tank 13 can easily be performed. Thus, the heat exchanger main body 11 can more easily be manufactured.

Second Embodiment

In the first embodiment, the flat pipe having the flat sectional shape is used as the heat transfer pipe 15. However, a circular pipe having a circular sectional shape may be used as the heat transfer pipe 15.

Figure 9:
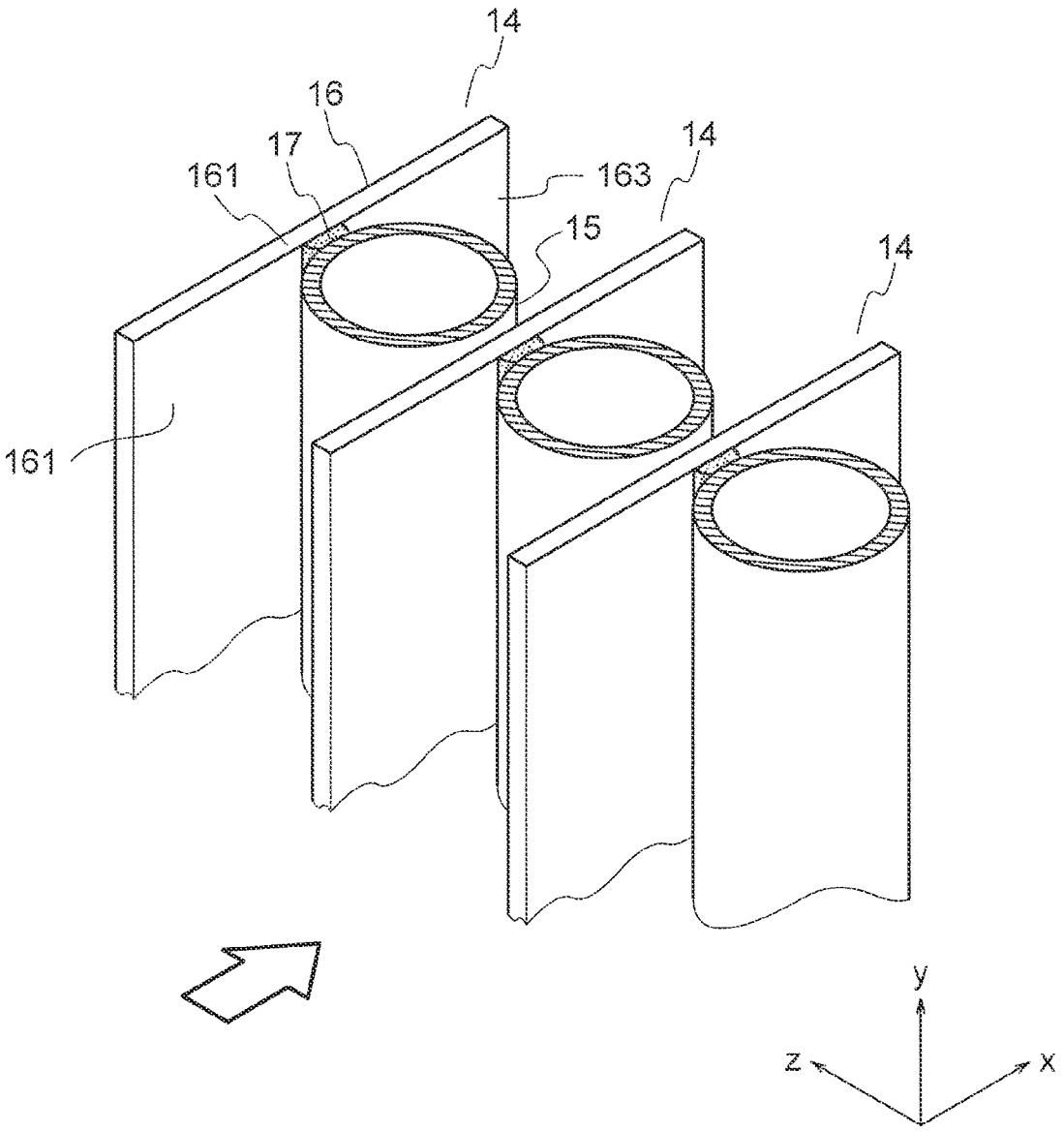
FIG. 9 is a perspective view for illustrating a state in which heat exchange members of an outdoor heat exchanger according to a second embodiment of the present invention are cut.
Figure 10:
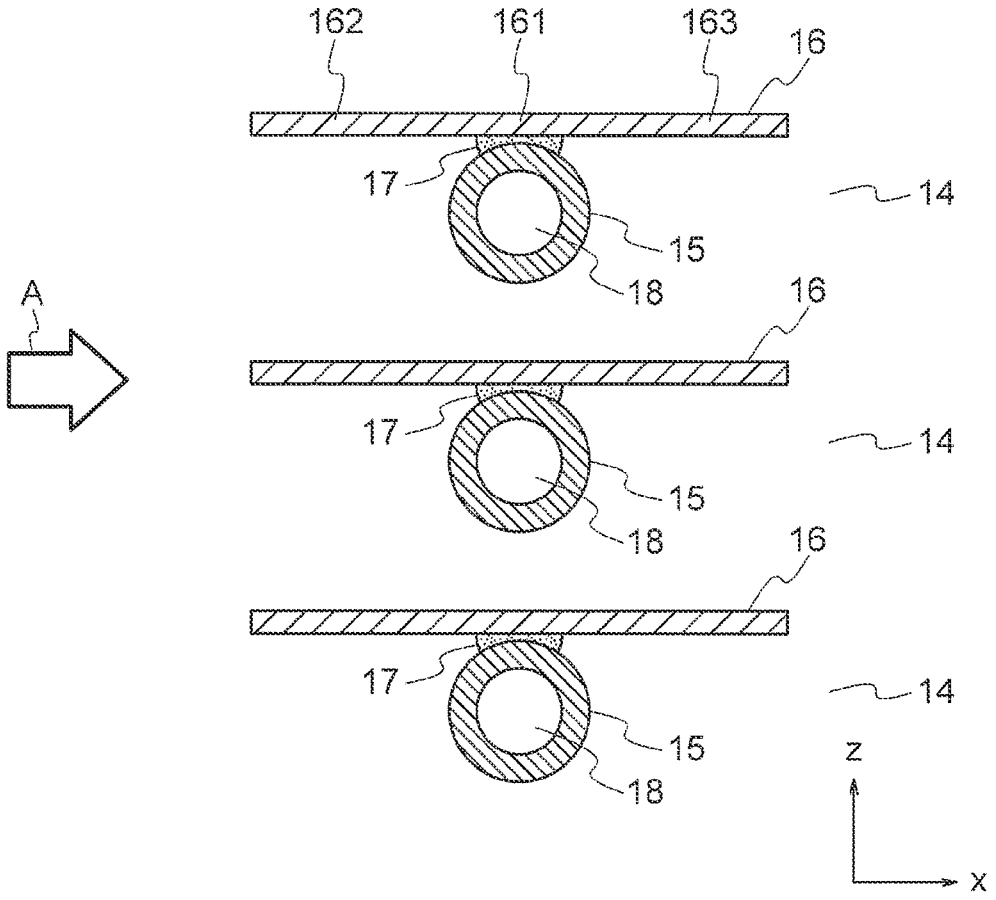
FIG. 10 is a sectional view for illustrating the heat exchange members of FIG. 9.

FIG. 9 is a perspective view for illustrating a state in which the heat exchange members 14 of the outdoor heat exchanger 3 according to a second embodiment of the present invention are cut. FIG. 10 is a sectional view for illustrating the heat exchange members 14 of FIG. 9. In this embodiment, the sectional shape of each of the heat transfer pipes 15 is circular. Further, in this embodiment, one refrigerant flow passage 18 is formed in one heat transfer pipe 15. Other configurations are the same as those of the first embodiment.

As described above, even when the circular pipes, each having the circular sectional shape, are used as the heat transfer pipes 15, as in the first embodiment, a heat transfer area of each of the heat exchange members 14 can be increased with the presence of the extending portions 162 and 163. Thus, the heat exchange performance of the outdoor heat exchanger 3 can be improved. Further, the heat transfer plate 16 is a member formed separately from the heat transfer pipe 15. Thus, as in the first embodiment, the shape of the heat transfer pipe 15 and the shape of the heat transfer plate 16 can be simplified. As a result, the outdoor heat exchanger 3 can easily be manufactured.

Third Embodiment

Figure 11:
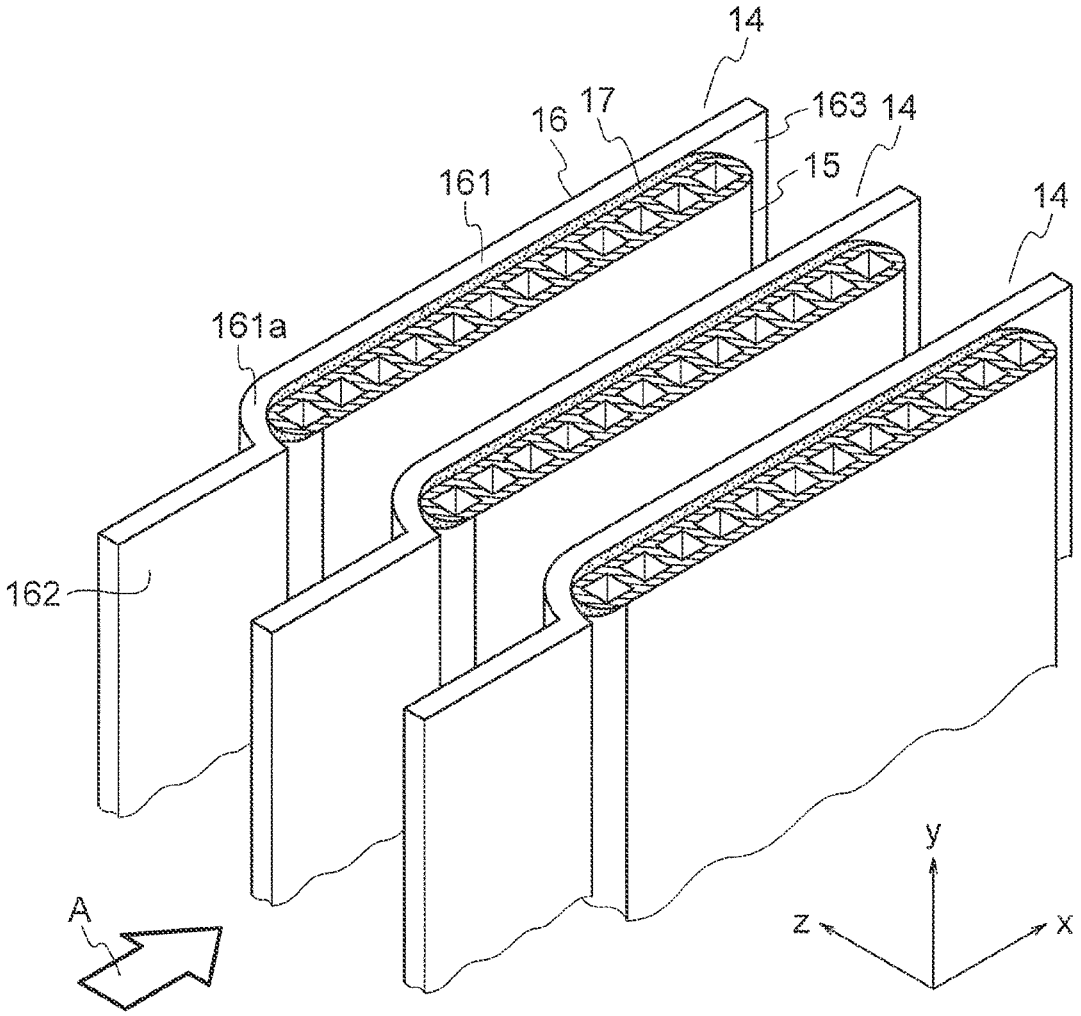
FIG. 11 is a perspective view for illustrating a state in which heat exchange members of an outdoor heat exchanger according to a third embodiment of the present invention are cut.
Figure 12:
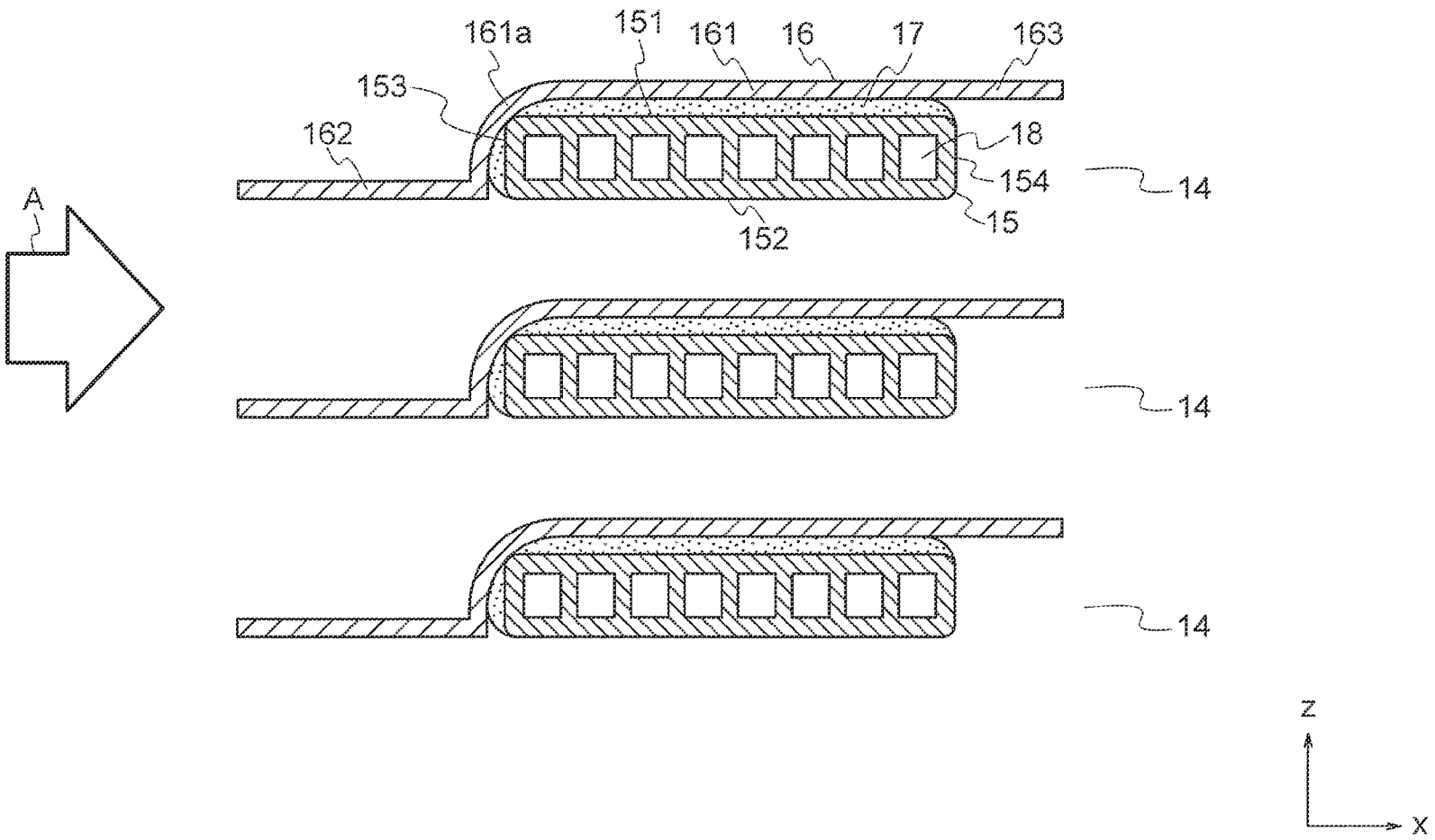
FIG. 12 is a sectional view for illustrating the heat exchange members of FIG. 11.

FIG. 11 is a perspective view for illustrating a state in which the heat exchange members 14 of the outdoor heat exchanger 3 according to a third embodiment of the present invention are cut. FIG. 12 is a sectional view for illustrating the heat exchange members 14 of FIG. 11. An outer peripheral surface of each of the heat transfer pipes 15 includes a first thickness-direction end surface 151, a second thickness-direction end surface 152, an upstream-side end surface 153, and a downstream-side end surface 154. The first thickness-direction end surface 151 and the second thickness-direction end surface 152 are opposed to each other in the thickness direction of the heat transfer pipe 15. The upstream-side end surface 153 and the downstream-side end surface 154 are opposed to each other in the width direction of the heat transfer pipe 15. The heat transfer pipe 15 is arranged so that the upstream-side end surface 153 is oriented toward an upstream side of the air stream A with respect to the downstream-side end surface 154.

The heat transfer plate main body portion 161 overlaps the first thickness-direction end surface 151 of the heat transfer pipe 15. An end portion of the heat transfer plate main body portion 161 on the upstream side in a direction of the air stream A is a curved portion 161*a* that covers the outer peripheral surface of the heat transfer pipe 15. Thus, the curved portion 161*a* of the heat transfer plate main body portion 161 covers the upstream-side end surface 153 of the heat transfer pipe 15. The joining member 17 is provided between the first thickness-direction end surface 151 and the heat transfer plate main body portion 161 and between the upstream-side end surface 153 of the heat transfer pipe 15 and the heat transfer plate main body portion 161. The curved portion 161*a* of the heat transfer plate main body portion 161 is more gently inclined than the upstream-side end surface 153 of the heat transfer pipe 15 with respect to the direction of the air stream A.

The second thickness-direction end surface 152 and the downstream-side end surface 154 of the heat transfer pipe 15 are exposed to the outside. The extending portion 162 of the heat transfer plate 16 on the upstream side extends from an end of the curved portion 161*a* toward the upstream side of the air stream A. The extending portion 162 of the heat transfer plate 16 on the upstream side is arranged in alignment with a position of the second thickness-direction end surface 152 of the heat transfer pipe 15 in the thickness direction of the heat transfer pipe 15.

Figure 13:
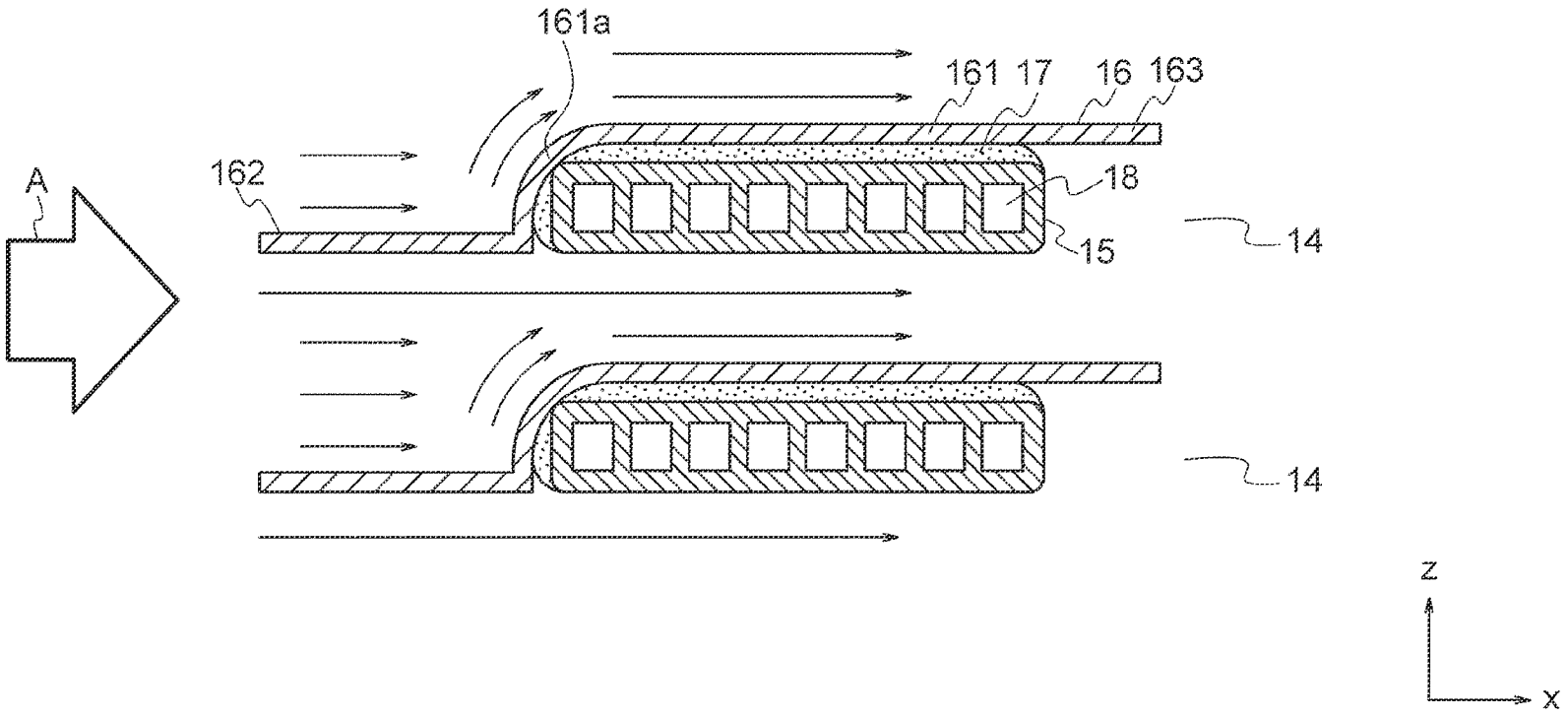
FIG. 13 is a sectional view for illustrating a flow of an air stream passing between the plurality of heat exchanger members of FIG. 12.

FIG. 13 is a sectional view for illustrating a flow of the air stream A passing between the plurality of heat exchange members 14 of FIG. 12. The air stream A passing between the plurality of heat exchange members 14 flows along surfaces of the heat exchange members 14 as indicated by the arrows in FIG. 13. Thus, the air stream A, which has reached the heat transfer plate main body portion 161 from the extending portion 162 on the upstream side, smoothly flows along a surface of the curved portion 161*a* without colliding against the upstream-side end surface 153 of the heat transfer pipe 15. Further, the air stream A, which has reached the second thickness-direction end surface 152 of the heat transfer pipe 15 from the extending portion 162 on the upstream side, directly flows along the second thickness-direction end surface 152. As a result, a resistance to the flow of the air stream A when the air stream A passes between the plurality heat exchange members 14 is reduced. Other configurations are the same as those of the first embodiment.

In the outdoor heat exchanger 3, each of the heat transfer plates 16 has the curved portion 161*a* that covers the outer peripheral surface of the heat transfer pipe 15. The extending portion 162 on the upstream side extends from the end of the curved portion 161*a*. Thus, the air stream A can smoothly flow along the curved portion 161*a*. In this manner, the resistance to the flow of the air stream A passing between the plurality of heat exchange members 14 can be reduced. In addition, a heat transfer area between the outer peripheral surface of the heat transfer pipe 15 and the heat transfer plate main body portion 161 can be increased. Thus, the heat exchange performance of the outdoor heat exchanger 3 can be further increased. Further, when the heat transfer pipe 15 and the heat transfer plate 16 are combined, a position of the heat transfer plate 16 with respect to the heat transfer pipe 15 can easily be specified based on a position of the curved portion 161*a*. In this manner, the outdoor heat exchanger 3 can more easily be manufactured.

In the example described above, the extending portion 162 on the upstream side is arranged in alignment with the position of the second thickness-direction end surface 152 of the heat transfer pipe 15 in the thickness direction of the heat transfer pipe 15. However, the extending portion 162 on the upstream side may be arranged so as to be shifted in the thickness direction of the heat transfer pipe 15 with respect to the position of the second thickness-direction end surface 152 of the heat transfer pipe 15. Even with the arrangement described above, the air stream A can smoothly flow along the curved portion 161*a*. Thus, the resistance to the flow of the air stream A passing between the plurality of heat exchange members 14 can be reduced.

Figure 14:
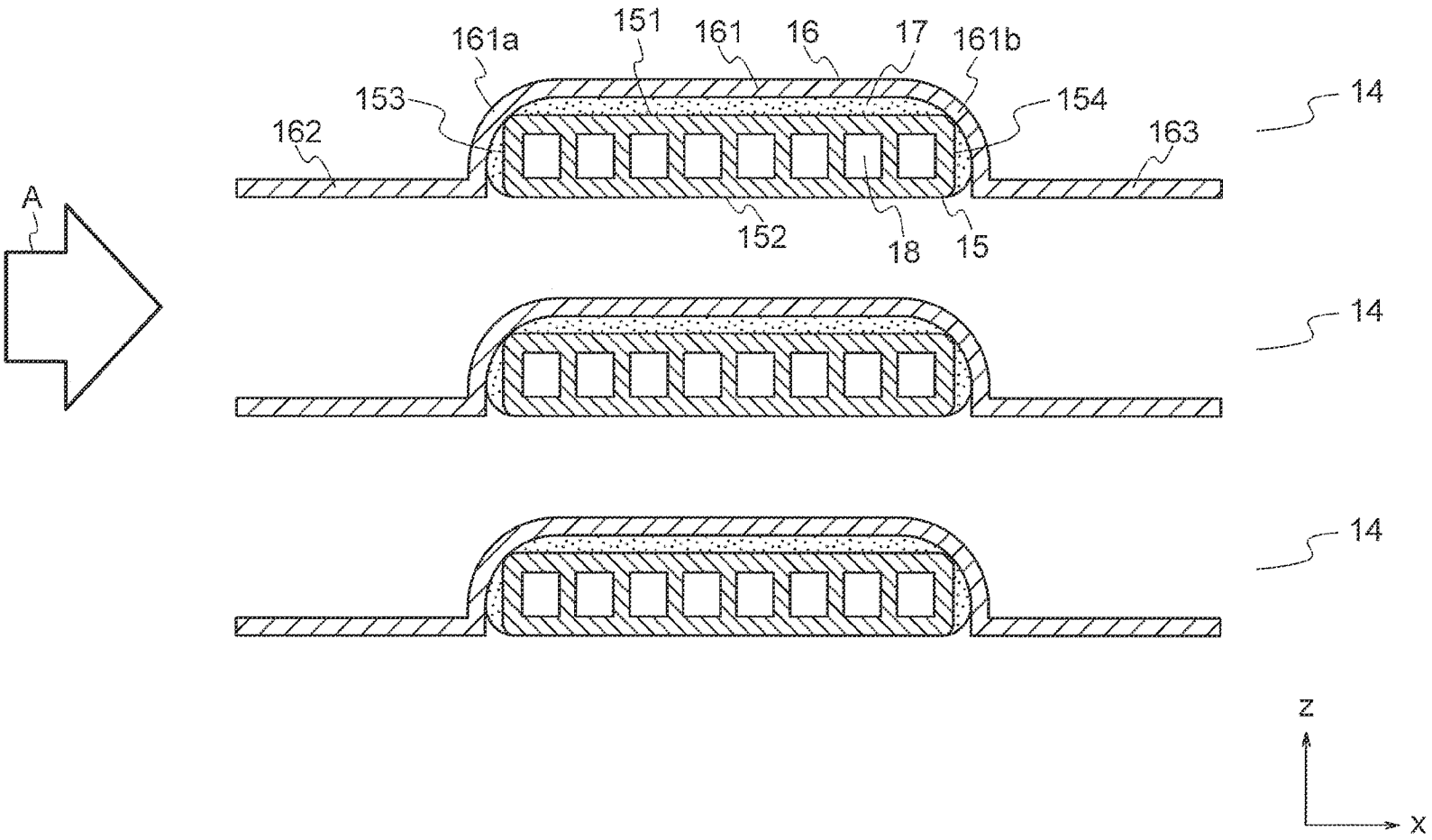
FIG. 14 is a sectional view for illustrating another example of the heat exchange members of the outdoor heat exchanger according to the third embodiment of the present invention.

In the example described above, only the end portion of the heat transfer plate main body portion 161 on the upstream side in the direction of the air stream A is formed as the curved portion 161*a*. However, as illustrated in FIG. 14, the end portions of the heat transfer plate main body portion 161 on the upstream side and the downstream side in the direction of the air stream A may be formed as the curved portion 161*a* and a curved portion 161*b*, respectively. In this case, the curved portion 161*a* of the heat transfer plate main body portion 161 on the upstream side covers the upstream-side end surface 153 of the heat transfer pipe 15, and the curved portion 161*b* of the heat transfer plate main body portion 161 on the downstream side covers the downstream-side end surface 154 of the heat transfer pipe 15. Further, in this case, the extending portion 162 on the upstream side extends from the end of the curved portion 161*a* on the upstream side, and the extending portion 163 on the downstream side extends from an end of the curved portion 161*b* on the downstream side. Further, in this case, the extending portion 162 on the upstream side and the extending portion 163 on the downstream side are arranged in alignment with the position of the second thickness-direction end surface 152 of the heat transfer pipe 15 in the thickness direction of the heat transfer pipe 15.

Fourth Embodiment

Figure 15:
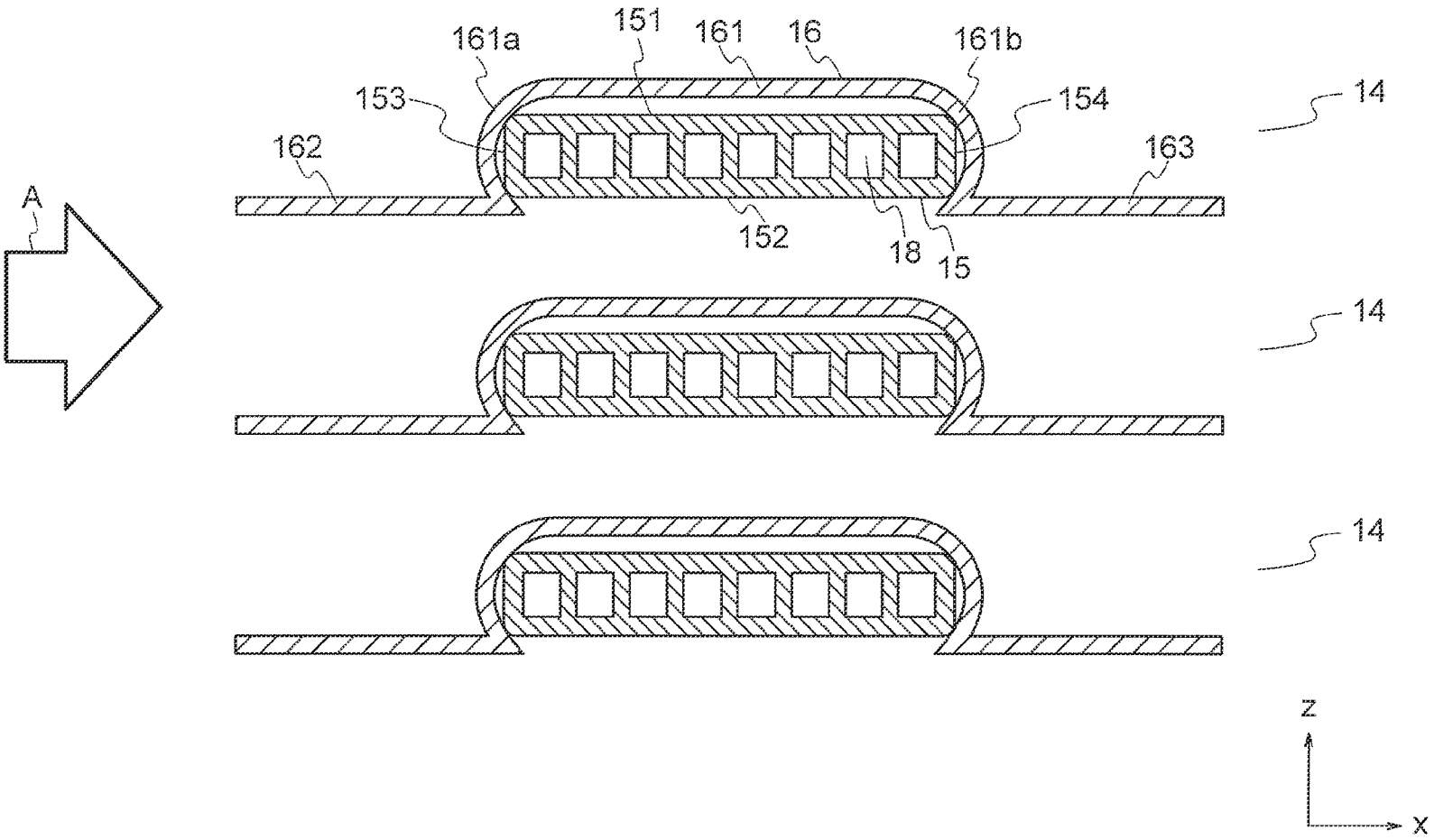
FIG. 15 is a sectional view for illustrating heat exchange members of an outdoor heat exchanger according to a fourth embodiment of the present invention.

FIG. 15 is a sectional view for illustrating the heat transfer members 14 of the outdoor heat exchanger 3 according to a fourth embodiment of the present invention. The end portions of the heat transfer plate main body portion 161 on the upstream side and the downstream side in the direction of the air stream A are formed as the curved portion 161*a* and 161*b*, which cover the outer peripheral surface of the heat transfer pipe 15. The curved portion 161*a* of the heat transfer plate main body portion 161 on the upstream side covers the upstream-side end surface 153 of the heat transfer pipe 15, and the curved portion 161*b* of the heat transfer plate main body portion 161 on the downstream side covers the downstream-side end surface 154 of the heat transfer pipe 15.

The heat transfer pipe 15 is held between the curved portions 161*a* and 161*b* under a state in which the curved portions 161*a* and 161*b* of the heat transfer plate main body portion 161 on the upstream side and the downstream side are elastically deformed. The curved portion 161*a* on the upstream side generates an elastic restoration force in a direction of pressing the end of the heat transfer pipe 15 on the upstream side, and the curved portion 161*b* on the downstream side generates an elastic restoration force in a direction of pressing the end of the heat transfer pipe 15 on the downstream side. In this manner, the heat transfer plate 16 is held on the heat transfer pipe 15 under a state in which the heat transfer plate main body portion 161 is held in contact with the outer peripheral surface of the heat transfer pipe 15. In this example, the joining member 17 is not provided between the outer peripheral surface of the heat transfer pipe 15 and the heat transfer plate main body portion 161.

When the heat transfer member 14 is manufactured, the heat transfer pipe 15 is inserted between the curved portion 161*a* on the upstream side and the curved portion 161*b* on the downstream side under a state in which the curved portions 161*a* and 161*b* are elastically deformed in a direction in which the curved portions 161*a* and 161*b* are separated away from each other. After that, the elastic deformation of the curved portions 161*a* and 161*b* is restored. In this manner, the heat transfer pipe 15 is held between the curved portions 161*a* and 161*b* to fix the heat transfer plate 16 to the heat transfer pipe 15. The heat exchange member 14 is completed after the fixation of the heat transfer plate 16 to the heat transfer pipe 15. Other configurations are the same as those of the first embodiment.

In the outdoor heat exchanger 3 described above, the heat transfer pipe 15 is held between the curved portions 161*a* and 161*b* with the elastic restoration forces of the curved portions 161*a* and 161*b* of the heat transfer plate main body portion 161 on the upstream side and the downstream side. Hence, the need of the joining member 17 configured to join the heat transfer plate 16 to the heat transfer pipe 15 can be eliminated. As a result, the heat exchange member 14 can easily be manufactured.

Fifth Embodiment

Figure 16:
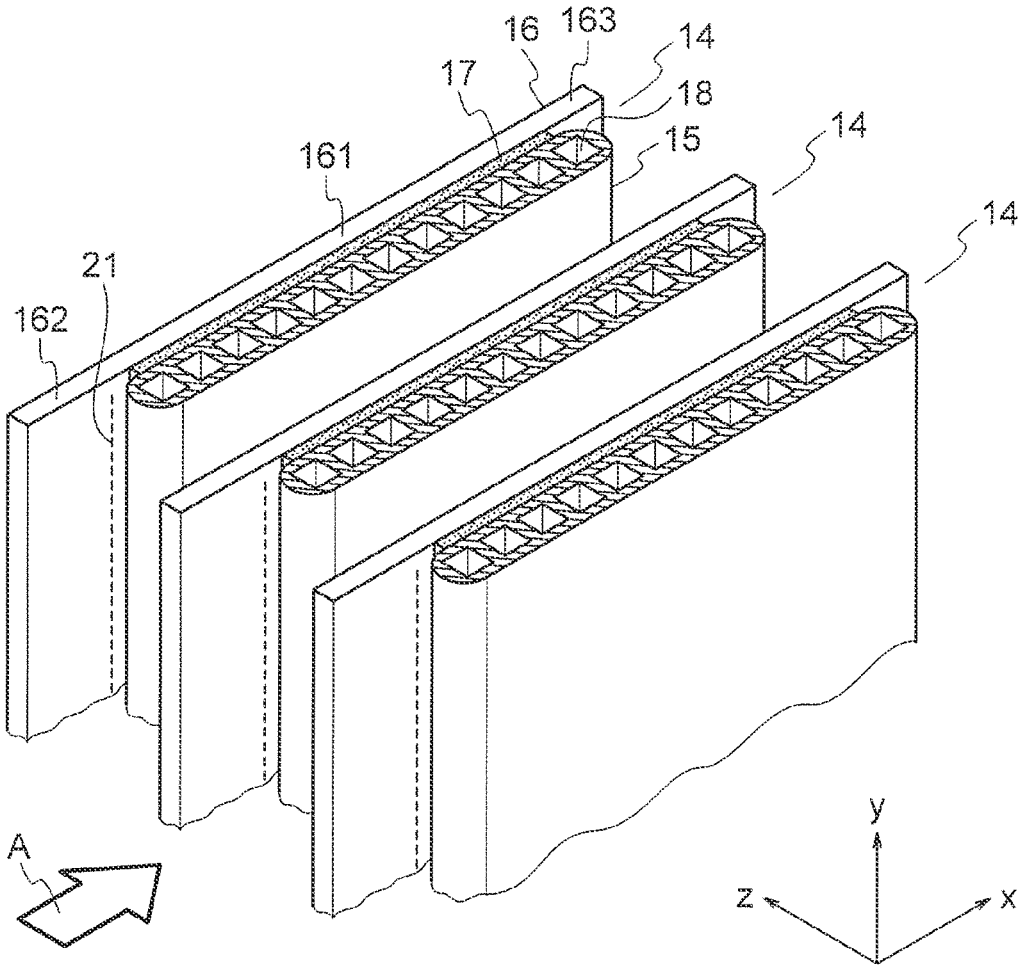
FIG. 16 is a perspective view for illustrating a state in which heat exchange members of an outdoor heat exchanger according to a fifth embodiment of the present invention are cut.
Figure 17:
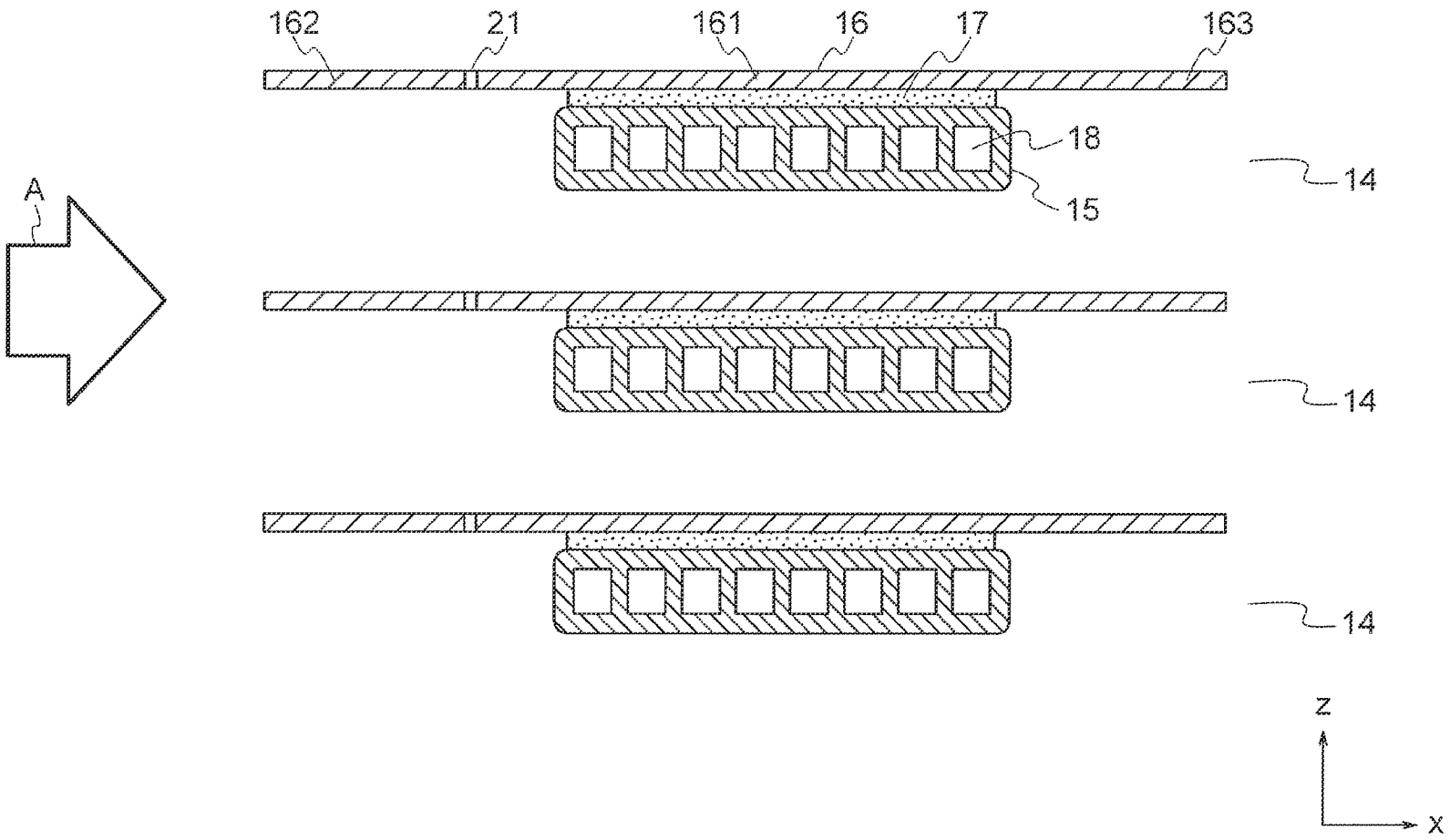
FIG. 17 is a sectional view for illustrating the heat exchange members of FIG. 16.

FIG. 16 is a perspective view for illustrating a state in which the heat exchange members 14 of the outdoor heat exchanger 3 according to a fifth embodiment of the present invention are cut. FIG. 17 is a sectional view for illustrating the heat exchange members 14 of FIG. 16. A plurality of cutout portions 21 serving as heat resistance portions configured to suppress heat conduction through the extending portion 162 on the upstream side are formed in the extending portion 162. Each of the cutout portions 21 is a linear cut passing in the thickness direction of the extending portion 162. In this example, the plurality of cutout portions 21 are formed in the extending portion 162 along the longitudinal direction of the heat transfer pipe 15. Other configurations are the same as those of the first embodiment.

When the outdoor heat exchanger 3 functions as an evaporator, the heat exchange member 14 is sometimes frosted. A frosting amount on the heat exchange member 14 increases as a difference between a temperature of the refrigerant B flowing through the refrigerant flow passages 18 and a temperature of the air stream A becomes larger. When the frosting amount on the heat exchange member 14 increases, a space between the plurality of heat exchange members 14 is reduced due to the presence of frost. Thus, the air stream A is less likely to pass between the plurality of heat exchange members 14.

In this embodiment, transfer of heat from the extending portion 162 to the heat transfer pipe 15 is suppressed with the presence of the plurality of cutout portions 21. As a result, a decrease of the temperature of the extending portion 162 can be suppressed, and the heat transfer member 14 is less liable to be frosted. Further, even when the heat exchange member 14 is frosted, the frosting amount is small.

In the outdoor heat exchanger 3 described above, the plurality of cutout portions 21 serving as the heat resistance portions configured to suppress the heat conduction from a distal end of the extending portion 162 toward the heat transfer plate main body portion 161 are formed in the extending portion 162 on the upstream side. Thus, the decrease of the temperature of the extending portion 162 on the upstream side can be suppressed. In this manner, the increase of the difference between the temperature of the extending portion 162 and the temperature of the air stream A can be suppressed. As a result, the heat exchange members 14 becomes less liable to be frosted.

Figure 18:
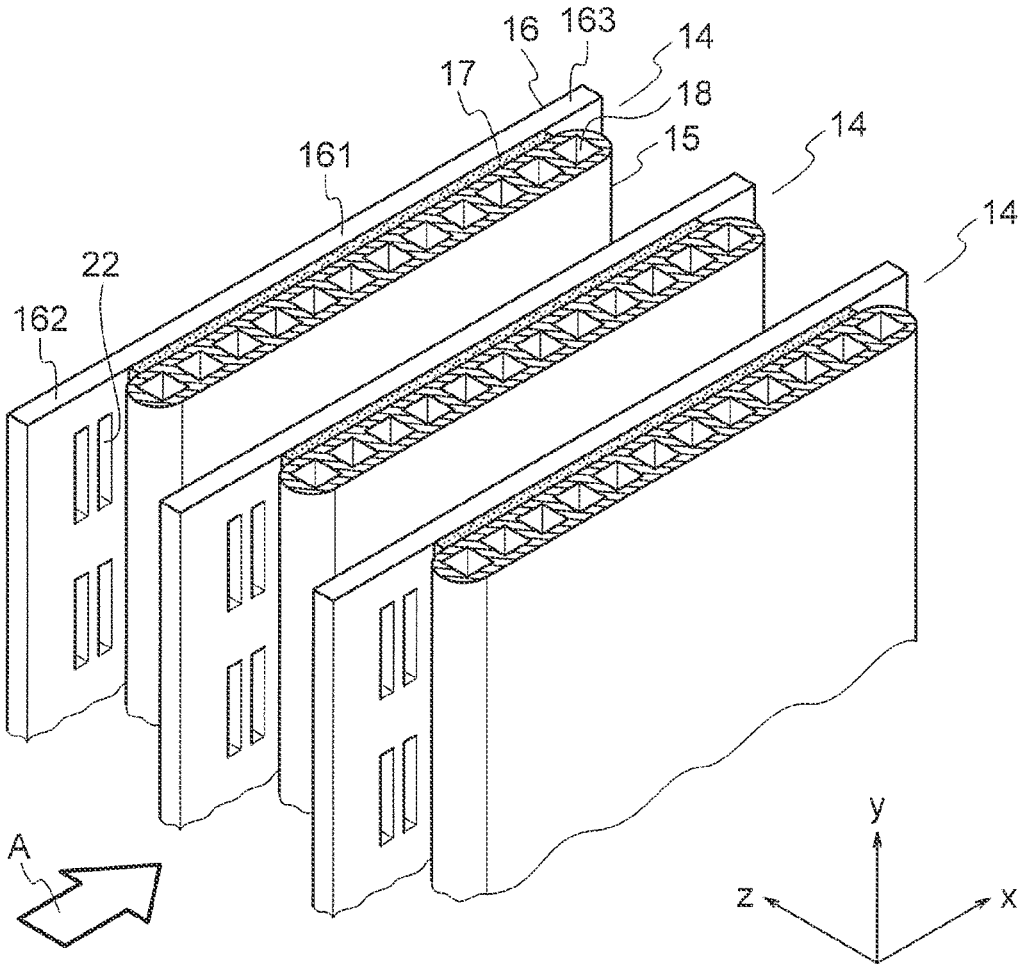
FIG. 18 is a perspective view for illustrating a state in which the heat exchange members of another example of the outdoor heat exchanger according to the fifth embodiment of the present invention are cut.
Figure 19:
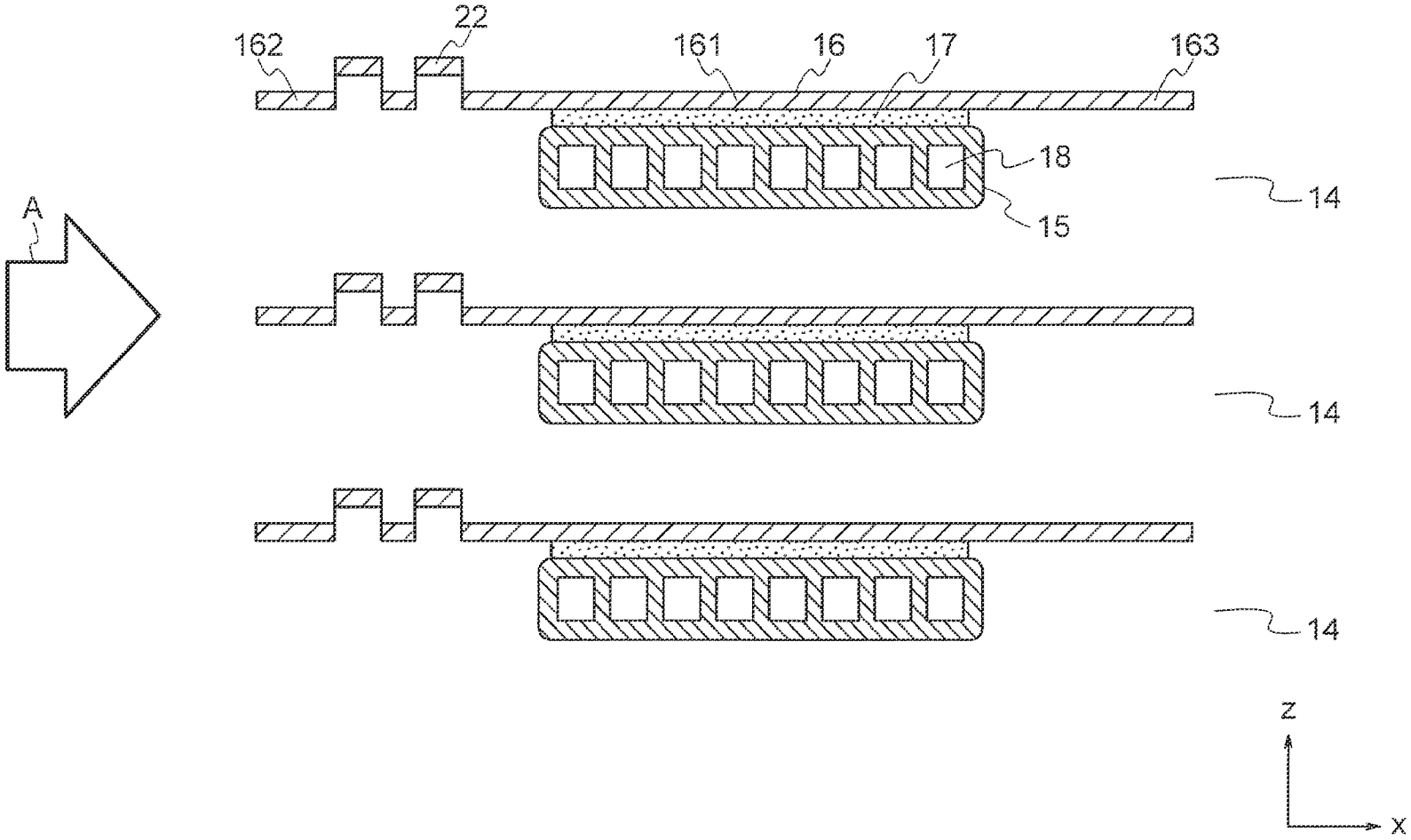
FIG. 19 is a sectional view for illustrating the heat exchange members of FIG. 18.

In the example described above, the plurality of cutout portions 21 are used as the heat resistance portions. However, the heat resistance portions are not limited thereto. For example, as illustrated in FIG. 18 and FIG. 19, a plurality of cut-and-raised portions 22 may be used as the heat resistance portions. Each of the cut-and-raised portions 22 is a portion formed by deforming and raising a portion between two parallel cuts formed in the extending portion 162 in the thickness direction of the extending portion 162. In this case, the plurality of cut-and-raised portions 22 are formed along the longitudinal direction of the heat transfer pipe 15.

Figure 20:
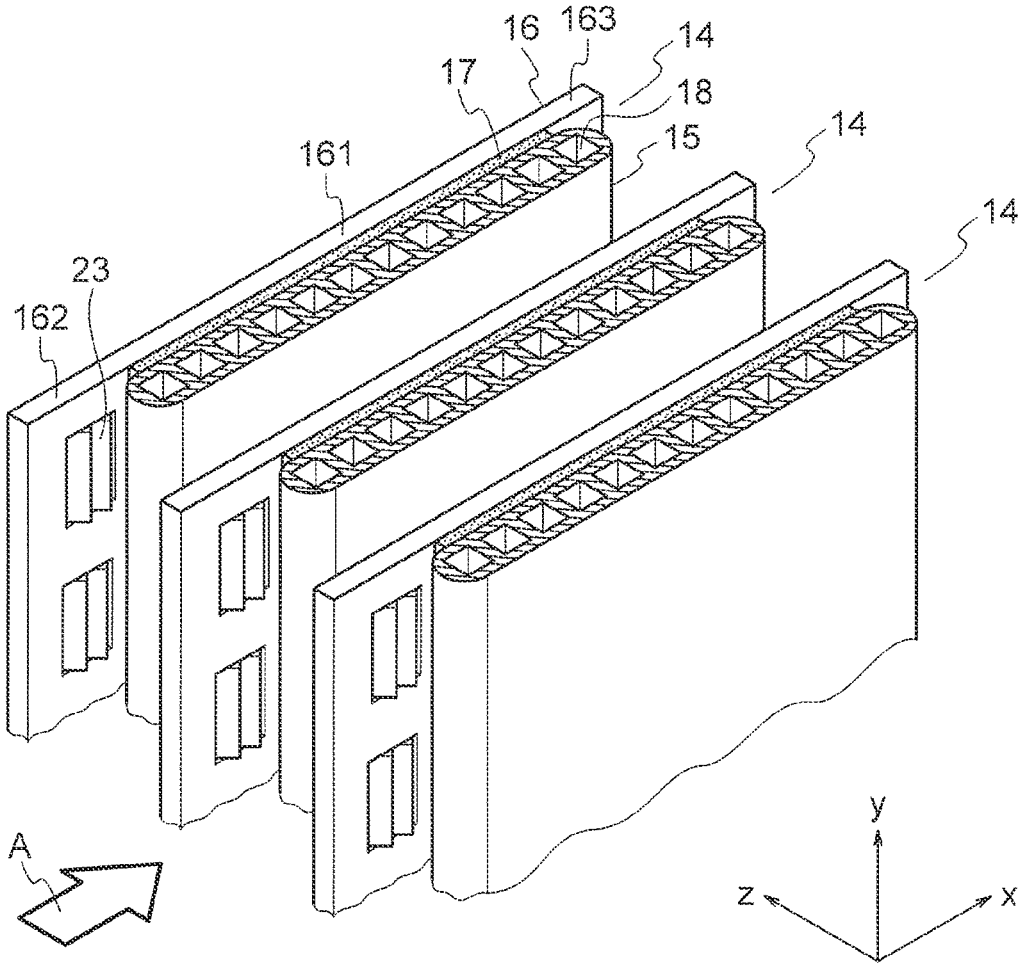
FIG. 20 is a perspective view for illustrating a state in which the heat exchange members of another example of the outdoor heat exchanger according to the fifth embodiment of the present invention are cut.
Figure 21:
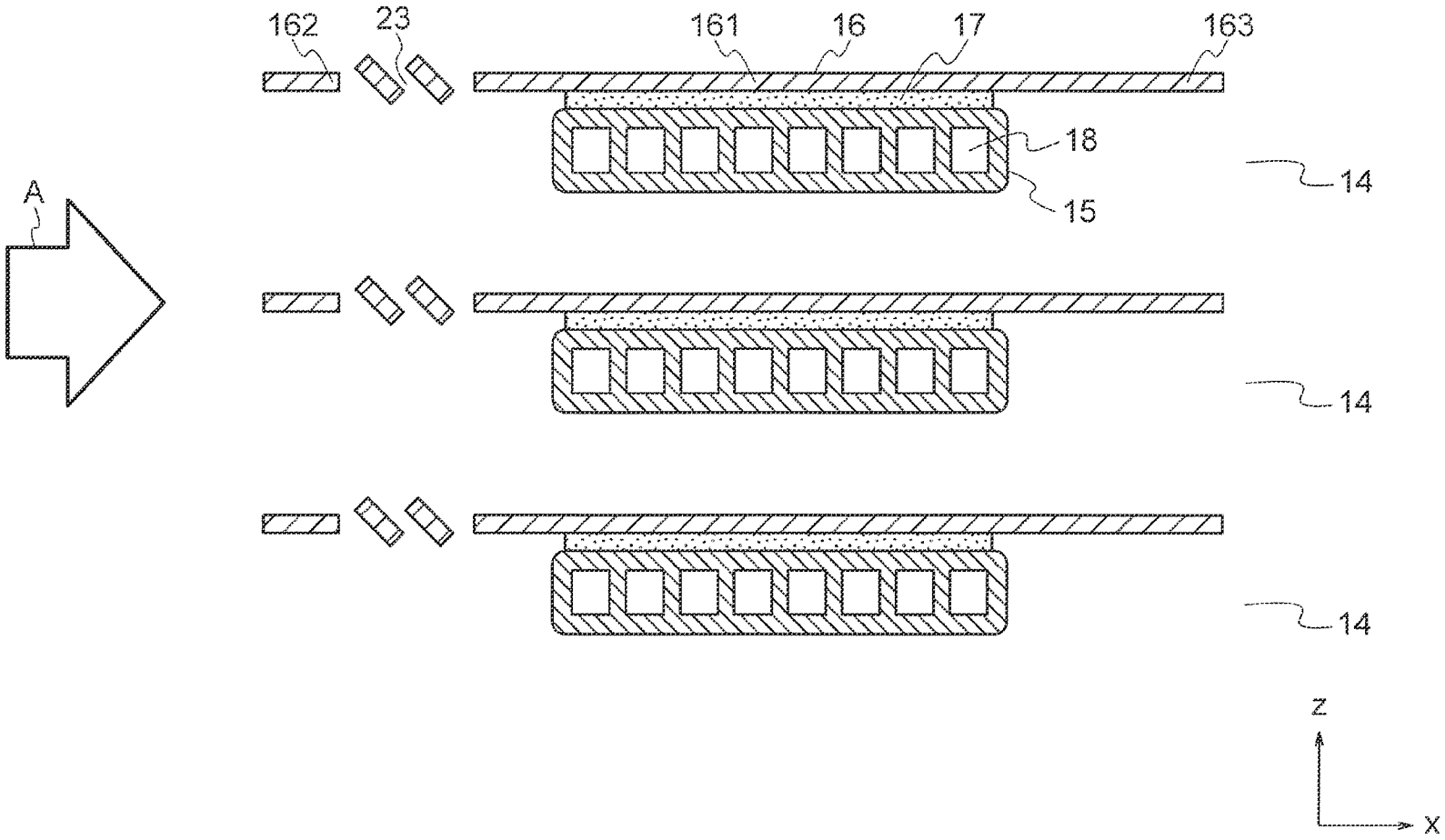
FIG. 21 is a sectional view for illustrating the heat exchange members of FIG. 20.

Further, for example, as illustrated in FIG. 20 and FIG. 21, a plurality of louvers 23 may be used as the heat resistance portions. Each of the louvers 23 is formed by deforming a portion between two parallel cuts formed in the extending portion 162 and inclining the portion with respect to a surface of the extending portion 162. In this case, the plurality of louvers 23 are formed along the longitudinal direction of the heat transfer pipe 15.

In the example described above, the cutout portions 21, the cut-and-raised portions 22, or the louvers 23 serving as the heat resistance portions are applied to the heat exchange members 14 of the first embodiment. However, the cutout portions 21, the cut-and-raised portions 22, or the louvers 22 serving as the heat resistance portions may be applied to the heat exchange members 14 of the second to fourth embodiments.

Sixth Embodiment

Figure 22:
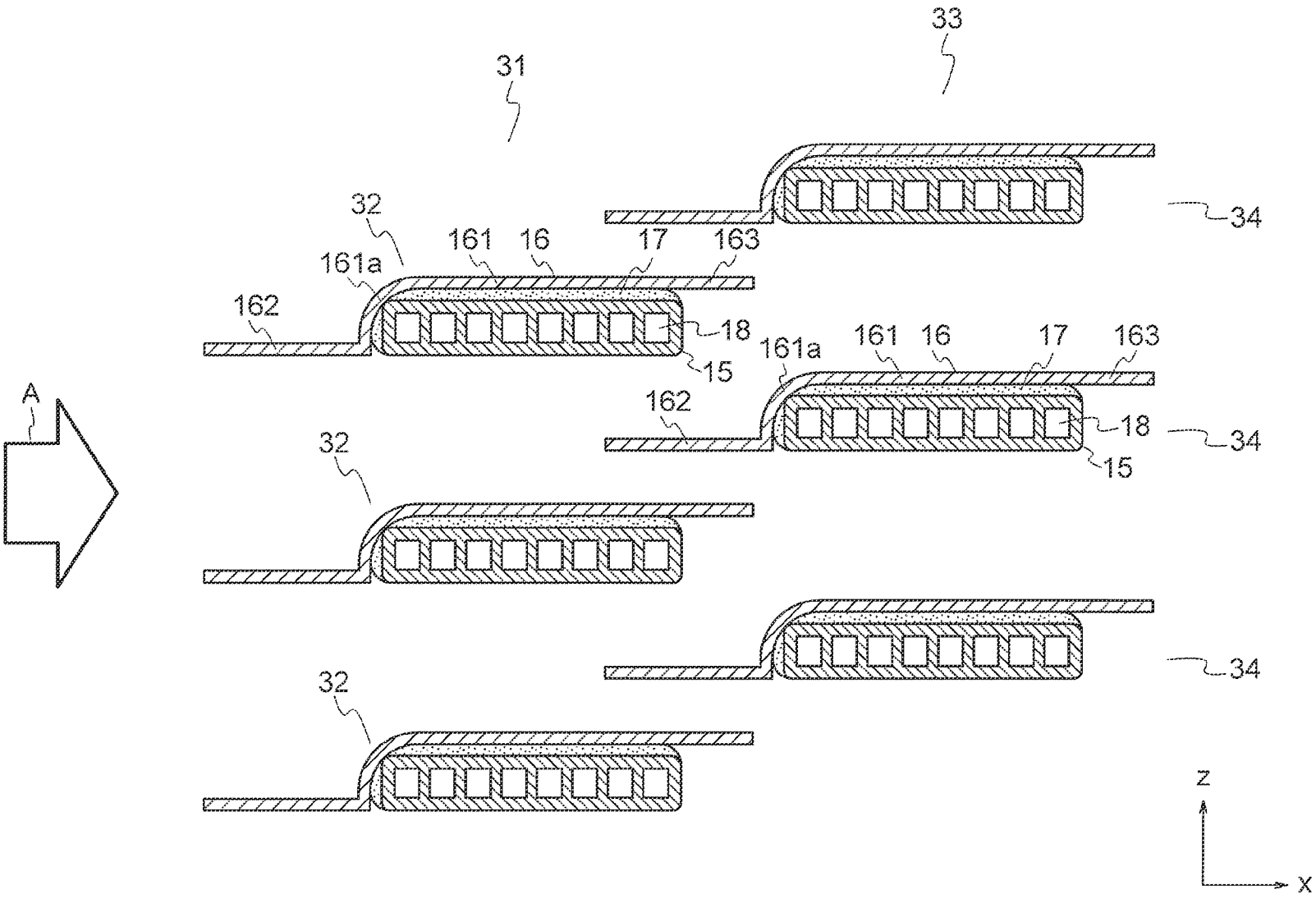
FIG. 22 is a sectional view for illustrating heat exchange members of an outdoor heat exchanger according to a sixth embodiment of the present invention.

FIG. 22 is a sectional view for illustrating the heat exchange members 14 of the outdoor heat exchanger 3 according to a sixth embodiment of the present invention. The heat exchanger main body 11 includes a plurality of first heat exchange members 32 and a plurality of second heat exchange members 34 as the plurality of heat exchange members. Configurations of the plurality of first heat exchange members 32 and the plurality of second heat exchange members 34 are the same as those of the heat exchange members 14 of the third embodiment.

The plurality of first heat exchange members 32 are arranged in a first line 31 so as to be spaced apart from each other. In the first line, the plurality of first heat exchange members 32 are arranged in the z direction. Each of the first heat exchange members 32 is arranged under a state in which the thickness direction of the heat transfer pipe 15 matches with the z direction.

The plurality of second heat exchange members 34 are arranged in a second line 33, which is located at a position distant from the first line 31, so as to be spaced apart from each other in the x direction. In this example, the second line 33 is located on the downstream side of the air stream A with respect to the first line 31. In the second line 33, the plurality of second heat exchange members 34 are arranged in the z direction. Each of the second heat exchange members 34 is arranged under a state in which the thickness direction of the heat transfer pipe 15 matches with the z direction.

The plurality of second heat exchange members 34 are arranged between the plurality of heat exchange members 32 when viewed along the x direction. Specifically, when the heat exchanger main body 11 is viewed along the x direction, overlapping of each of the second heat exchange members 34 with each of the first heat exchange members 32 is avoided. In this example, the first heat exchange members 32 and the second heat exchange members 34 are arranged at positions in a staggered pattern in which the first heat exchange members 32 and the second heat exchange members 34 are located alternately in the first line 31 and the second line 33 in the z direction.

The extending portion 162 of each of the second heat exchange members 34 on the upstream side is arranged in a space between the plurality of first heat exchange members 32. The extending portion 163 of each of the first heat exchange members 32 on the downstream side is arranged in a space between the plurality of second heat exchange members 34. With the arrangement described above, when the heat exchanger main body 11 is viewed along the z direction being a direction in which the plurality of first heat exchange members 32 and the plurality of second heat exchange members 34 are arranged, the extending portion 162 of each of the second heat exchange members 34 on the upstream side overlaps a downstream-side portion of the first heat exchange member 32, and the extending portion 163 of each of the first heat exchange members 32 on the downstream side overlaps an upstream-side portion of the second heat exchange member 34. Other configurations are the same as those of the third embodiment.

In the outdoor heat exchanger 3 described above, when viewed along the x direction, the plurality of second heat exchange members 34 are arranged between the plurality of first heat exchange members 32. Thus, the extending portions 162 of the second heat exchange members 34 arranged in the second line 33 can extend toward the first line 31 so as to avoid the first heat exchange members 32. Further, the extending portions 163 of the first heat exchange members 32 can extend toward the second line 33 so as to avoid the second heat exchange members 34. Further, portions of the second heat exchange members 34 on a side closer to the first line 31 can be inserted between portions of the plurality of first heat exchange members 32 on a side closer to the second line 33. Thus, an increase in dimensions of the heat exchanger main body 11 in the x direction can be suppressed. Further, the heat transfer plate 16 is formed separately from the heat transfer pipe 15. As a result, a thickness of the heat transfer plate 16 can be reduced. Thus, even when the extending portion 162 of the second heat exchange member 34 on the upstream side is inserted between the plurality of first heat exchange members 32, reduction of flow passages for the air stream A can be suppressed. In this manner, a heat transfer area of each of the first heat transfer members 32 and a heat transfer area of each of the second heat transfer members 34 for the air stream A can be increased while increase in size of the heat exchanger main body 11 is suppressed. Hence, the heat exchange performance of the heat exchanger main body 11 can be further improved.

In the example described above, the heat exchange members are arranged in two lines including the first line 31 and the second line 33. However, the number of lines in which the heat exchange members are arranged is not limited to two, and may be three or more. In this case, the plurality of heat exchange members arranged in one of two lines adjacent to each other are arranged between the plurality of heat exchange members arranged in another one of the lines.

Further, in the example described above, the extending portion 162 and the extending portion 163 project from the heat transfer plate main body portion 161 of each of the first heat exchange members 32 toward the upstream side and the downstream side of the air stream A, respectively. However, the extending portion 162 may project from the heat transfer plate main body portion 161 of each of the first heat exchange members 32 only toward the upstream side, which is one of the upstream side and the downstream side of the air stream A, or the extending portion 163 may project from the heat transfer plate main body portion 161 only toward the downstream side, which is one of the upstream side and the downstream side of the air stream A.

Further, in the example described above, the extending portion 162 and the extending portion 163 project from the heat transfer plate main body portion 161 of each of the second heat exchange members 34 toward the upstream side and the downstream side of the air stream A, respectively. However, the extending portion 162 may project from the heat transfer plate main body portion 161 of each of the second heat exchange members 34 only toward the upstream side, which is one of the upstream side and the downstream side of the air stream A, or the extending portion 163 may project from the heat transfer plate main body portion 161 only toward the downstream side, which is one of the upstream side and the downstream side of the air stream A.

Further, in the example described above, the configuration of each of the heat exchange members 14 of the third embodiment is applied to each of the first heat exchange members 32. However, the configuration of each of the heat exchange members 14 of the first, second, fourth, or fifth embodiment may be applied to each of the first heat exchange members 32.

Further, in the example described above, the configuration of each of the heat exchange members 14 of the third embodiment is applied to each of the second heat exchange members 34. However, the configuration of each of the heat exchange members 14 of the first, second, fourth, or fifth embodiment may be applied to each of the second heat exchange members 34.

Seventh Embodiment

Figure 23:
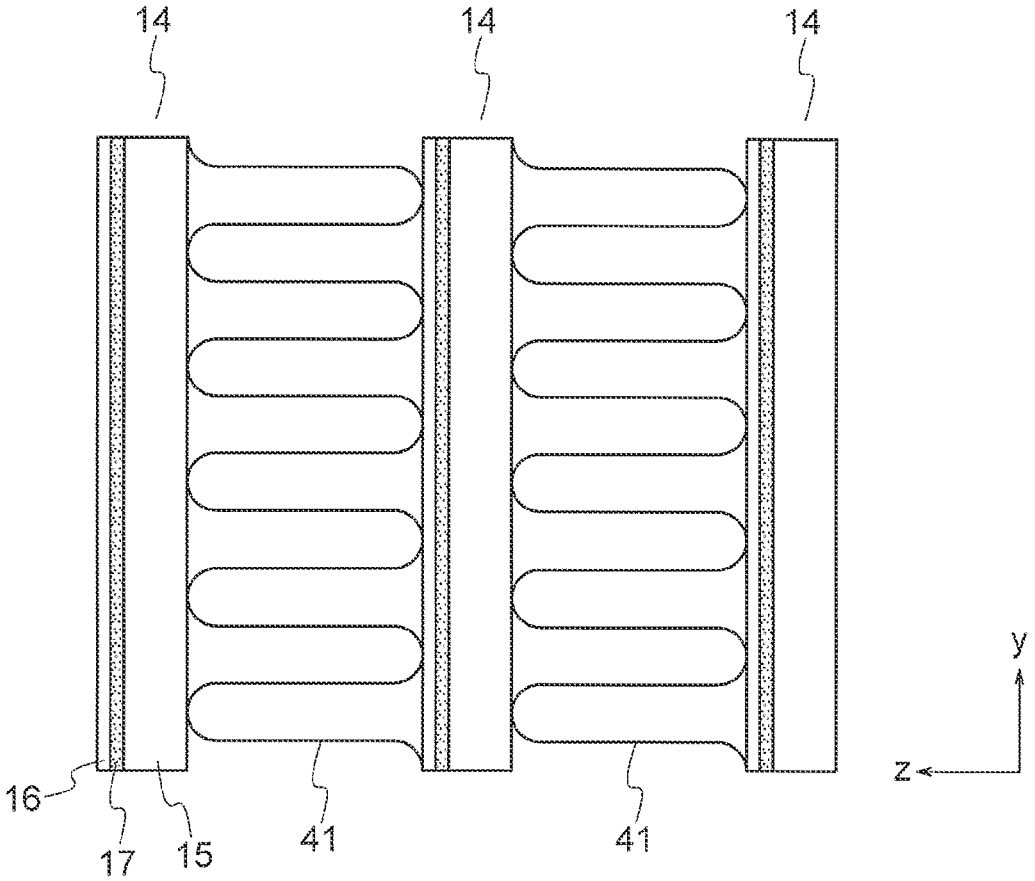
FIG. 23 is a front view for illustrating a main part of a heat exchanger main body of an outdoor heat exchanger according to a seventh embodiment of the present invention.

FIG. 23 is a front view for illustrating a main part of the heat exchanger main body 11 of the outdoor heat exchanger 3 according to a seventh embodiment of the present invention. The heat exchanger main body 11 includes the plurality of heat exchange members 14 and heat transfer fins 41, each being connected between two adjacent ones of the heat exchange members 14. Arrangement and configuration of the plurality of heat exchange members 14 are the same as those of the first embodiment.

In this example, a corrugated fin formed in a corrugated shape is used as each of the heat transfer fins 41. Further, in this example, each of the heat transfer fins 41 is connected only to a portion of each of the heat exchange members 14 on the downstream side in the direction of the air stream A, specifically, in the x direction. As a material for forming the heat transfer fins 41, for example, aluminum, an aluminum alloy, copper, or a copper alloy is used. Other configurations are the same as those of the first embodiment.

In the outdoor heat exchanger 3 described above, each of the heat transfer fins 41 is connected between two adjacent ones of the heat exchange members 14. Thus, a heat transfer area of the heat exchange main body 11 for the air stream A can be further increased with the presence of the heat transfer fins 41. In this manner, the heat exchange performance of the heat exchanger main body 11 can be further improved.

Further, the heat transfer fin 41 is connected only to the portion of the heat exchange member 14 on the downstream side in the direction of the air stream A. Thus, the heat transfer fins 41 can be arranged so as to avoid portions of the heat exchange members 14 on the upstream side, which are liable to be frosted. In this manner, reduction in heat transfer performance of the heat transfer fins 41 due to frosting can be suppressed.

In the example described above, the heat transfer fin 41 is connected to only part of each of the heat exchange members 14 in the direction of the air stream A. However, the heat transfer fin 41 may be connected to the entire region of each of the heat exchange members 14 in the direction of the air stream A.

In the example described above, the heat transfer fins 41 are applied to the heat exchanger main body 11 of the first embodiment. However, the heat transfer fins 41 may be applied to the heat exchanger main body 11 of the second to sixth embodiments.

Eighth Embodiment

Figure 24:
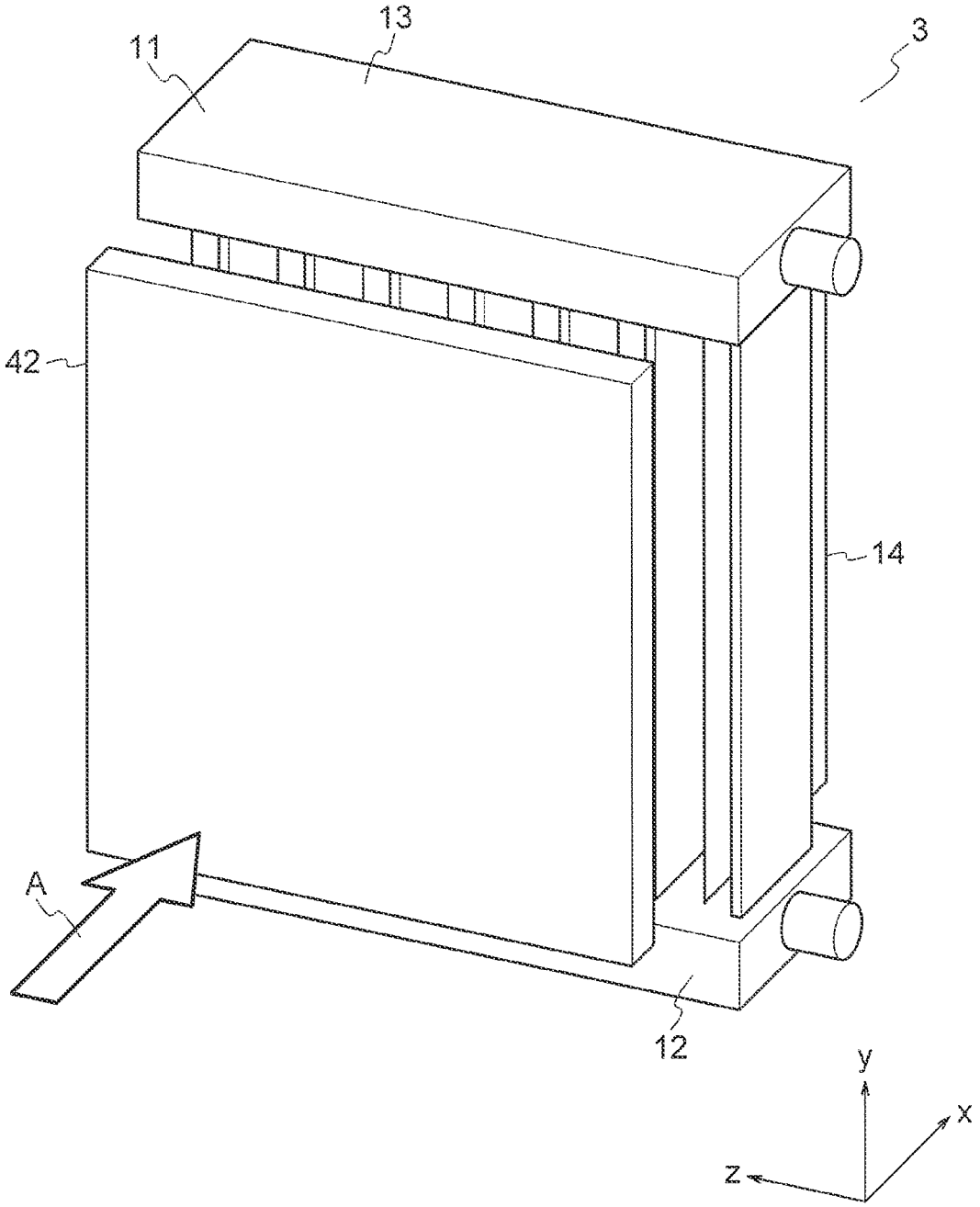
FIG. 24 is a perspective view for illustrating an outdoor heat exchanger according to an eighth embodiment of the present invention.

FIG. 24 is a perspective view for illustrating the outdoor heat exchanger 3 according to an eighth embodiment of the present invention. The outdoor heat exchanger 3 includes the heat exchanger main body 11 and a vortex generator 42. The vortex generator 42 is arranged on a windward side of the plurality of heat exchange members 14 of the heat exchanger main body 11 in the x direction being the third direction, specifically, on the upstream side of the air stream A with respect to the plurality of heat exchange members 14. A configuration of the heat exchanger main body 11 is the same as that of the first embodiment. The vortex generator 42 is known in the art, and is not independently relied upon for patentability.

The vortex generator 42 is configured to form the air stream A into a vortex flow. Further, the vortex generator 42 is arranged so as to be apart from the heat exchange main body 11 in the x direction being the third direction. A gap that is present between the vortex generator 42 and the heat exchange main body 11 is reduced to be as small as possible. The air stream A, which has passed through the vortex generator 42, is formed into the vortex flow and passes between the plurality of heat exchange members 14. In this manner, heat exchange between the refrigerant B flowing through the refrigerant flow passages 18 and the air stream A is promoted in a region from the ends of the heat exchange members 14 on the upstream side to the ends of the heat exchange members 14 on the downstream side. Other configurations are the same as those of the first embodiment.

In the outdoor heat exchanger 3 described above, the vortex generator 42 is arranged on the windward side of the heat exchange main body 11 in the x direction. Thus, the air stream. A, which has been formed into the vortex flow, can be supplied to the heat exchange main body 11. In this manner, the heat exchange between the refrigerant B and the air stream A can be promoted in each of the heat exchange members 14. Thus, the heat exchange performance of the outdoor heat exchanger 3 can be further improved.

Further, the vortex generator 42 is arranged at the position distant from the heat exchanger main body 11. Thus, transfer of heat of the heat exchange members 14 to the vortex generator 42 can be prevented. As a result, generation of dew and frost on the vortex generator 42 can be prevented, and hence the air stream A in the vortex generator 42 can be prevented from being blocked by dew and frost.

In the example described above, the vortex generator 42 is arranged so as to be apart from the heat exchanger main body 11 in the x direction. However, the vortex generator 42 may be arranged so as to be held in contact with each of the heat exchange members 14 of the heat exchanger main body 11. Even in this way, with the arrangement of the vortex generator 42 on the upstream side of the air stream A with respect to the heat generator main body 11, the air stream A, which has been formed into the vortex flow, can be supplied to the heat generator main body 11. Thus, the heat exchange performance in the heat exchanger main body 11 can be improved.

Further, in the example described above, the vortex generator 42 is applied to the outdoor heat exchanger 3 according to the first embodiment. However, the vortex generator 42 may be applied to the outdoor heat exchanger 3 according to the second to seventh embodiments.

Further, in the first to third embodiments and the fifth to eighth embodiments, the joining member 17 is used as a joining member configured to join the heat transfer plate 16 to the heat transfer pipe 15. However, the joining member is not limited thereto. For example, an adhesive having heat conduction performance may be used as the joining member.

Further, in the first to third embodiments and the fifth to eighth embodiments, the heat transfer plate 16 is joined to the heat transfer pipe 15 through the joining member 17 therebetween. However, the heat transfer plate 16 may be directly joined to the heat transfer pipe 15 by, for example, welding or friction stir welding as in the second embodiment.

Further, in the first and third to eighth embodiments, the flat pipe having a flat sectional shape is used as the heat transfer pipe 15. However, the circular pipe having a circular sectional shape may be used as the heat transfer pipe 15.

Further, in the first to fifth, seventh, and eighth embodiments, the extending portions 162 and 163 project from the heat transfer plate main body portion 161 toward the upstream side and the downstream side of the air stream A, respectively. However, the extending portion 162 may project from the heat transfer plate main body portion 161 only toward the upstream side, which is one of the upstream side and the downstream side of the air stream A, or the extending portion 163 may project from the heat transfer plate main body portion 161 only toward the downstream side, which is one of the upstream side and the downstream side of the air stream A.

Further, in each of the embodiments described above, the present invention is applied to the outdoor heat exchanger 3. However, the present invention may be applied to the indoor heat exchanger 5. Further, in each of the embodiments described above, the refrigeration cycle apparatus according to the present invention is used as the air conditioning apparatus 1. However, the use of the refrigeration cycle apparatus is not limited thereto. For example, the refrigeration cycle apparatus according to the present invention may be used as, for example, a cooling device, a refrigeration apparatus, or a water heater. Further, in each of the embodiments described above, the present invention is applied to the refrigeration cycle apparatus having the four-way valve 6, which is capable of performing switching between the cooling operation and the heating operation. However, the present invention may be applied to a heat exchanger for a refrigeration cycle apparatus without the four-way valve 6.

The present invention is not limited to the embodiments described above, and can be carried out with various changes within the scope of the present invention. Further, the present invention can also be carried out with combinations of the embodiments described above.

The invention claimed is:

1. A heat exchanger, comprising a plurality of heat exchange members arranged in a first direction so as to be spaced apart from each other, wherein each of the plurality of heat exchange members includes:

a heat transfer pipe extending in a second direction intersecting with the first direction; and a heat transfer plate provided to the heat transfer pipe along the second direction, wherein the heat transfer plate includes an extending portion extending away from the heat transfer pipe in a third direction intersecting with each of the first direction and the second direction, wherein the heat transfer plate is a member formed separately from the heat transfer pipe, wherein the heat transfer pipe is a flat pipe, wherein a thickness direction of the flat pipe matches with the first direction, wherein an outer peripheral surface of the flat pipe includes a first thickness-direction end surface and a second thickness-direction end surface, which are opposed to each other in the thickness direction of the flat pipe, wherein the heat transfer plate has a heat transfer plate main body portion overlapping the first thickness-direction end surface, wherein the heat transfer plate main body portion has a curved portion configured to cover the outer peripheral surface of the flat pipe, wherein the outer peripheral surface of the flat pipe includes an upstream-side end surface, and a downstream-side end surface, wherein the upstream-side end surface and the downstream-side end surface are opposed to each other in the width direction of the flat pipe, wherein the curved portion covers the upstream-side end surface, wherein the second thickness-direction end surface and the downstream-side end surface are uncovered and exposed to air, wherein the extending portion includes a first extending portion which extends from an end of the curved portion, and wherein the first extending portion is arranged in alignment with a position of the second thickness-direction end surface in the thickness direction of the flat pipe.

2. The heat exchanger according to claim 1, wherein the heat transfer plate is joined to the flat pipe through a joining member therebetween.

3. The heat exchanger according to claim 1, wherein the extending portion has a heat resistance portion configured to suppress heat conduction through the extending portion.

4. The heat exchanger according to claim 1, further comprising header tanks to which the plurality of heat exchange members are connected, wherein ends of the heat transfer pipe of each of the plurality of heat exchange members project from the heat transfer plate in the second direction, and wherein the ends of the heat transfer pipe, which project from the heat transfer plate, are inserted into spaces inside the header tanks, respectively.

5. The heat exchanger according to claim 1, wherein the plurality of heat exchange members include:

a plurality of first heat exchange members arranged in a first line; and a plurality of second heat exchange members arranged in a second line located at a position distant from the first line in the third direction, wherein, when viewed along the third direction, each of the plurality of second heat exchange members is arranged between adjacent ones of the plurality of first heat exchange members.

6. The heat exchanger according to claim 1, further comprising a heat transfer fin connected between adjacent ones of the plurality of heat exchange members.

7. The heat exchanger according to claim 1, further comprising a vortex generator arranged on a windward side of the plurality of heat exchange members in the third direction.

8. The heat exchanger according to claim 7, wherein the vortex generator is arranged so as to be apart from the plurality of heat exchange members.

9. The heat exchanger according to claim 1, wherein the flat pipe has a long axis and a short axis on a cross section orthogonal to the second direction, and wherein the extending portion includes a second extending portion which extends from the heat transfer plate main body portion.

10. A refrigeration cycle apparatus, comprising:

a compressor;

an outdoor heat exchanger;

an expansion valve; and an indoor heat exchanger, the outdoor heat exchanger comprising:

a plurality of heat exchange members arranged in a first direction so as to be spaced apart from each other, wherein each of the plurality of heat exchange members includes:

a heat transfer pipe extending in a second direction intersecting with the first direction; and a heat transfer plate provided to the heat transfer pipe along the second direction, wherein the heat transfer plate includes an extending portion extending away from the heat transfer pipe in a third direction intersecting with each of the first direction and the second direction, wherein the heat transfer plate is a member formed separately from the heat transfer pipe, wherein the heat transfer pipe is a flat pipe, wherein a thickness direction of the flat pipe matches with the first direction, wherein an outer peripheral surface of the flat pipe includes a first thickness-direction end surface and a second thickness-direction end surface, which are opposed to each other in the thickness direction of the flat pipe, wherein the heat transfer plate has a heat transfer plate main body portion overlapping the first thickness-direction end surface, wherein the heat transfer plate main body portion has a curved portion configured to cover the outer peripheral surface of the flat pipe, wherein the outer peripheral surface of the flat pipe includes an upstream-side end surface and a downstream-side end surface, wherein the upstream-side end surface and the downstream-side end surface are opposed to each other in the width direction of the flat pipe, wherein the curved portion covers the upstream-side end surface, wherein the second thickness-direction end surface and the downstream-side end surface are uncovered and exposed to air, wherein the extending portion includes a first extending portion which extends from an end of the curved portion, and wherein the first extending portion is arranged in alignment with a position of the second thickness-direction end surface in the thickness direction of the flat pipe.

11. A heat exchanger, comprising a plurality of heat exchange members arranged in a first direction so as to be spaced apart from each other, wherein each of the plurality of heat exchange members includes:

a heat transfer pipe extending in a second direction intersecting with the first direction; and a heat transfer plate provided to the heat transfer pipe along the second direction, wherein the heat transfer plate includes an extending portion extending away from the heat transfer pipe in a third direction intersecting with each of the first direction and the second direction, wherein the heat transfer plate is formed separately from the heat transfer pipe, wherein the heat transfer pipe is a flat pipe, wherein the heat exchanger further comprises a vortex generator arranged on a windward side of the plurality of heat exchange members in the third direction, wherein a thickness direction of the flat pipe matches with the first direction, wherein an outer peripheral surface of the flat pipe includes a first thickness-direction end surface and a second thickness-direction end surface, which are opposed to each other in the thickness direction of the flat pipe, wherein the heat transfer plate has a heat transfer plate main body portion overlapping the first thickness-direction end surface, wherein the heat transfer plate main body portion has a curved portion configured to cover the outer peripheral surface of the flat pipe, wherein the outer peripheral surface of the flat pipe includes an upstream-side end surface, and a downstream-side end surface, wherein the upstream-side end surface and the downstream-side end surface are opposed to each other in the width direction of the flat pipe, wherein the curved portion covers the upstream-side end surface, wherein the second thickness-direction end surface and the downstream-side end surface are uncovered and exposed to air, wherein the extending portion includes a first extending portion which extends from an end of the curved portion, and wherein the first extending portion is arranged in alignment with a position of the second thickness-direction end surface in the thickness direction of the flat pipe.

12. A refrigeration cycle apparatus, comprising:

a compressor;

an outdoor heat exchanger;

an expansion valve; and an indoor heat exchanger, a plurality of heat exchange members arranged in a first direction so as to be spaced apart from each other, wherein each of the plurality of heat exchange members includes:

a heat transfer pipe extending in a second direction intersecting with the first direction; and a heat transfer plate provided to the heat transfer pipe along the second direction, wherein the heat transfer plate includes an extending portion extending away from the heat transfer pipe in a third direction intersecting with each of the first direction and the second direction, wherein the heat transfer plate is formed separately from the heat transfer pipe, wherein the heat transfer pipe is a flat pipe, wherein the heat exchanger further comprises a vortex generator arranged on a windward side of the plurality of heat exchange members in the third direction, wherein a thickness direction of the flat pipe matches with the first direction, wherein an outer peripheral surface of the flat pipe includes a first thickness-direction end surface and a second thickness-direction end surface, which are opposed to each other in the thickness direction of the flat pipe, wherein the heat transfer plate has a heat transfer plate main body portion overlapping the first thickness-direction end surface, wherein the heat transfer plate main body portion has a curved portion configured to cover the outer peripheral surface of the flat pipe, wherein the outer peripheral surface of the flat pipe includes an upstream-side end surface and a downstream-side end surface, wherein the upstream-side end surface and the downstream-side end surface are opposed to each other in the width direction of the flat pipe, wherein the curved portion covers the upstream-side end surface, wherein the second thickness-direction end surface and the downstream-side end surface are uncovered and exposed to air, wherein the extending portion includes a first extending portion which extends from an end of the curved portion, and wherein the first extending portion is arranged in alignment with a position of the second thickness-direction end surface in the thickness direction of the flat pipe.

* * * * *